US009336741B2

(12) United States Patent
Kitagawa et al.

(10) Patent No.: US 9,336,741 B2
(45) Date of Patent: May 10, 2016

(54) VIDEO PROCESSING CIRCUIT, VIDEO PROCESSING METHOD, LIQUID CRYSTAL DISPLAY DEVICE, AND ELECTRONIC APPARATUS

(71) Applicant: Seiko Epson Corporation, Tokyo (JP)

(72) Inventors: Taku Kitagawa, Shiojiri (JP); Hiroyuki Hosaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 500 days.

(21) Appl. No.: 13/748,513

(22) Filed: Jan. 23, 2013

(65) Prior Publication Data

US 2013/0194249 A1 Aug. 1, 2013

(30) Foreign Application Priority Data

Jan. 30, 2012 (JP) ..... 2012-016389

(51) Int. Cl.
*G09G 3/36* (2006.01)

(52) U.S. Cl.
CPC ..... *G09G 3/3696* (2013.01); *G09G 3/3648* (2013.01); *G09G 3/3614* (2013.01); *G09G 2320/0261* (2013.01); *G09G 2340/0435* (2013.01); *G09G 2360/16* (2013.01)

(58) Field of Classification Search
CPC ..... G09G 3/36; G09G 3/3611; G09G 3/3614; G09G 3/3648; G09G 3/3696; G09G 2320/02; G09G 2320/0261; G09G 2320/0266; G09G 2340/0435; G09G 2360/16
USPC ..... 345/211–213, 87–104
See application file for complete search history.

(56) References Cited

U.S. PATENT DOCUMENTS

2007/0195028 A1* 8/2007 Katayama et al. ..... 345/87
2007/0273628 A1* 11/2007 Sato ..... G09G 3/3648 345/87
2009/0243983 A1 10/2009 Ohashi et al.
2010/0207934 A1 8/2010 Kato et al.
2011/0051006 A1 3/2011 Iisaka et al.
2011/0051007 A1 3/2011 Hosaka et al.
2011/0109815 A1 5/2011 Hosaka et al.
2011/0176071 A1 7/2011 Iisaka et al.
2011/0181795 A1 7/2011 Hosaka et al.
2011/0205207 A1 8/2011 Hosaka et al.

(Continued)

FOREIGN PATENT DOCUMENTS

JP 6-034965 A 2/1994
JP 2009-069608 A 4/2009

(Continued)

*Primary Examiner* — Nathan Danielsen
(74) *Attorney, Agent, or Firm* — ALG Intellectual Property, LLC

(57) ABSTRACT

A video processing circuit includes a boundary detection unit which detects a boundary between a first pixel in which an application voltage which is designated by a video signal Vid-in is lower than a first voltage and a second pixel which exceeds a second voltage in which the application voltage is higher than the first voltage in a normally black mode; and a correction unit which corrects a video signal in which an application voltage to a liquid crystal element corresponding to the first pixel which comes into contact with a boundary detected by the boundary detection unit is designated to be a video signal in which a correction voltage which is higher than the application voltage is designated in a part of period of one frame period, and a correction voltage which is lower than the application voltage is designated in other periods of the one frame period.

12 Claims, 28 Drawing Sheets

(56) References Cited

U.S. PATENT DOCUMENTS

| | | | |
|---|---|---|---|
| 2011/0205208 | A1 | 8/2011 | Iisaka et al. |
| 2011/0205439 | A1 | 8/2011 | Iisaka et al. |
| 2011/0205440 | A1 | 8/2011 | Hosaka et al. |
| 2011/0205452 | A1 | 8/2011 | Hosaka et al. |
| 2011/0205479 | A1 | 8/2011 | Hosaka et al. |
| 2012/0147272 | A1 | 6/2012 | Hosaka et al. |

FOREIGN PATENT DOCUMENTS

| | | | |
|---|---|---|---|
| JP | 2009-237366 | A | 10/2009 |
| JP | 2010-191157 | A | 9/2010 |
| JP | 2011-053390 | A | 3/2011 |
| JP | 2011-053417 | A | 3/2011 |
| JP | 2011-107174 | A | 6/2011 |
| JP | 2011-107497 | A | 6/2011 |
| JP | 2011-145501 | A | 7/2011 |
| JP | 2011-150223 | A | 8/2011 |
| JP | 2011-170235 | A | 9/2011 |
| JP | 2011-170236 | A | 9/2011 |
| JP | 2011-175136 | A | 9/2011 |
| JP | 2011-175137 | A | 9/2011 |
| JP | 2011-175199 | A | 9/2011 |
| JP | 2011-175200 | A | 9/2011 |
| JP | 2012-113226 | A | 6/2012 |
| JP | 2012-127991 | A | 7/2012 |
| JP | 2012-155212 | A | 8/2012 |
| JP | 2012-168229 | A | 9/2012 |
| WO | WO-2012-101990 | A | 2/2012 |

* cited by examiner

SCANNING LINE DRIVING CIRCUIT
FRAME
FIRST FIELD
SECOND FIELD
THIRD FIELD
FOURTH FIELD
H
VH
VL
Y1
Y2
Y3
Y4
Y(m−1)
Y(m)

VIDEO PROCESSING CIRCUIT
POSITIVE (POLARITY WRITING)
NEGATIVE (POLARITY WRITING)
Vx
Vcnt
Vw(+)
Vb(+)
Vb(−)
Vw(−)
Ha
H
FIRST ROW AND FIRST COLUMN
FIRST ROW AND SECOND COLUMN
FIRST ROW AND THIRD COLUMN
FIRST ROW AND n-TH COLUMN

FIG. 7

| | | VOLTAGE CORRESPONDING TO ORIGINAL GRAYSCALE [V] | | | | | | | | | |
|---|---|---|---|---|---|---|---|---|---|---|---|
| | | 2.824 | 2.51 | 2.196 | 1.882 | 1.569 | 1.255 | 0.941 | 0.627 | 0.314 | 0 |
| VOLTAGE CORRESPONDING TO CORRECTION GRAYSCALE [V] | 2.824 | 62.5 | 49.01 | 35.75 | 24.41 | 15.81 | 10.01 | 6.462 | 4.503 | 3.536 | 3.249 |
| | 2.51 | | 34.3 | 21.3 | 11.7 | 5.865 | 2.867 | 1.518 | 0.957 | 0.719 | 0.64 |
| | 2.196 | | | 10.7 | 4.348 | 1.613 | 0.671 | 0.352 | 0.23 | 0.18 | 0.164 |
| | 1.882 | | | | 1.37 | 0.46 | 0.207 | 0.119 | 0.084 | 0.067 | 0.06 |
| | 1.569 | | | | | 0.18 | 0.091 | 0.054 | 0.038 | 0.03 | 0.027 |
| | 1.255 | | | | | | 0.049 | 0.029 | 0.019 | 0.016 | 0.013 |
| | 0.941 | | | | | | | 0.018 | 0.011 | 0.007 | 0.006 |
| | 0.627 | | | | | | | | 0.006 | 0.004 | 0.002 |
| | 0.314 | | | | | | | | | 0.001 | 0.001 |
| | 0 | | | | | | | | | | 0 |

VIDEO SIGNAL Vid-in
60 Hz
MOVING BY ONE PIXEL
60 Hz
MOVING BY ONE PIXEL
TIME

VIDEO SIGNAL Vid-out
RISK BOUNDARY
240 Hz
240 Hz
240 Hz
c1
bk
c1
bk
c1
bk
c1
bk
c1
bk
c1
bk FIG. 9A VIDEO SIGNAL (BEFORE PROCESSING)
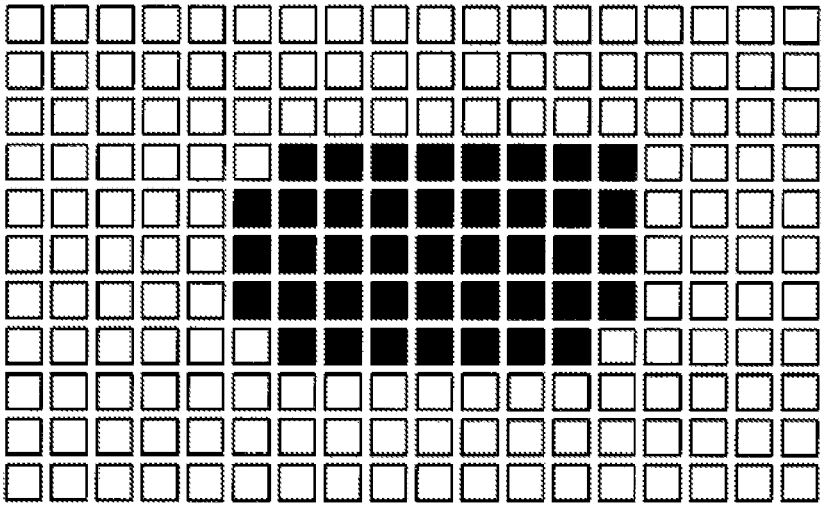
FIG. 9B DETECTING RISK BOUNDARY
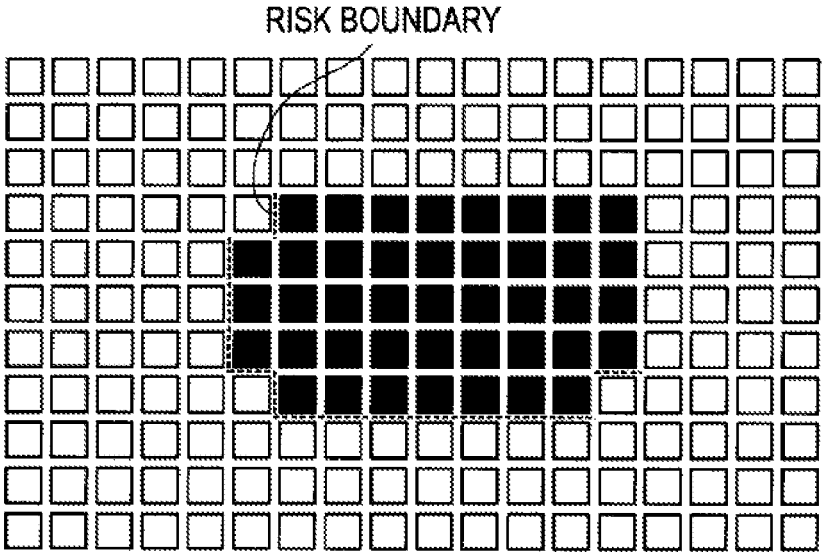

FIG. 10A CORRECTION PROCESSING (LOW POTENTIAL ONE PIXEL, $\theta b = 45^\circ$)
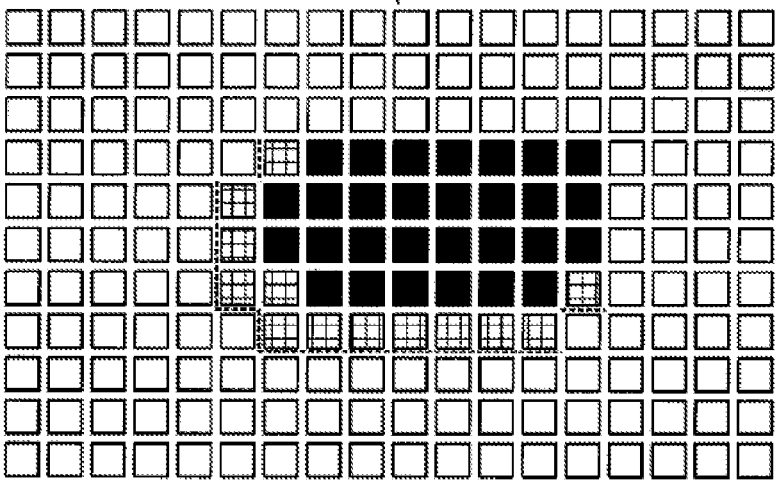
FIG. 10B CORRECTION PROCESSING (LOW POTENTIAL ONE PIXEL, $\theta b = 90^\circ$)
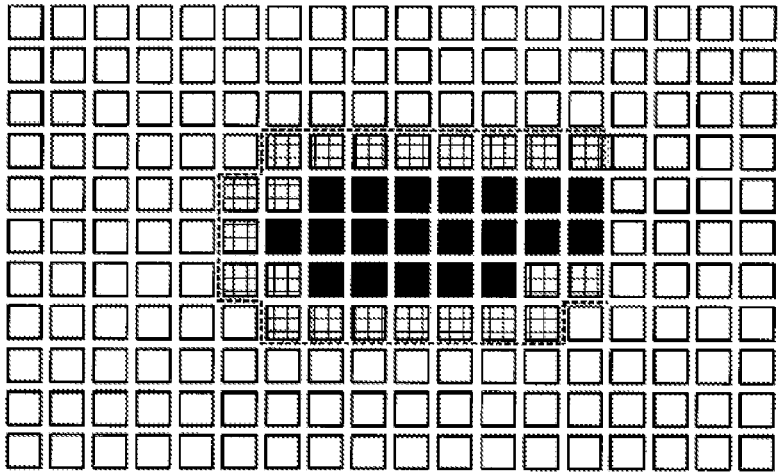
FIG. 10C CORRECTION PROCESSING (LOW POTENTIAL ONE PIXEL, $\theta b = 225^\circ$)
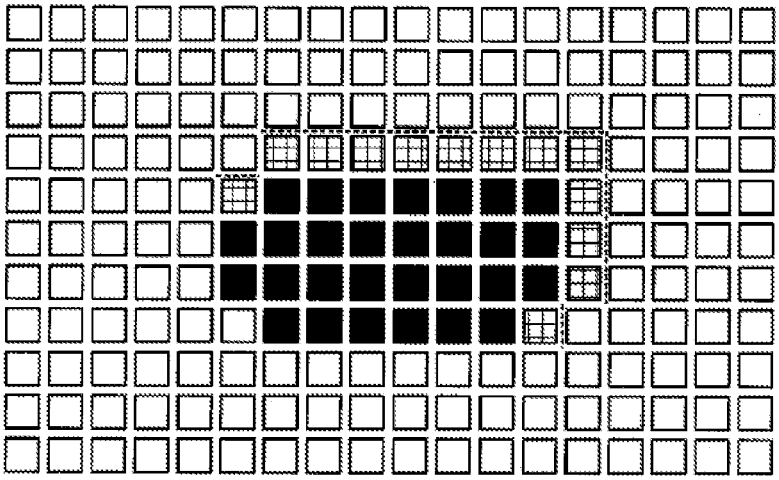

VIDEO SIGNAL Vid-in

VIDEO SIGNAL Vid-out
RISK BOUNDARY
240 Hz
240 Hz
240 Hz
c1
bk
MOVING BY ONE PIXEL
MOVING BY ONE PIXEL
60 Hz
60 Hz
TIME FIG. 14A CORRECTION PROCESSING (LOW POTENTIAL TWO PIXELS, $\theta b = 45^\circ$)
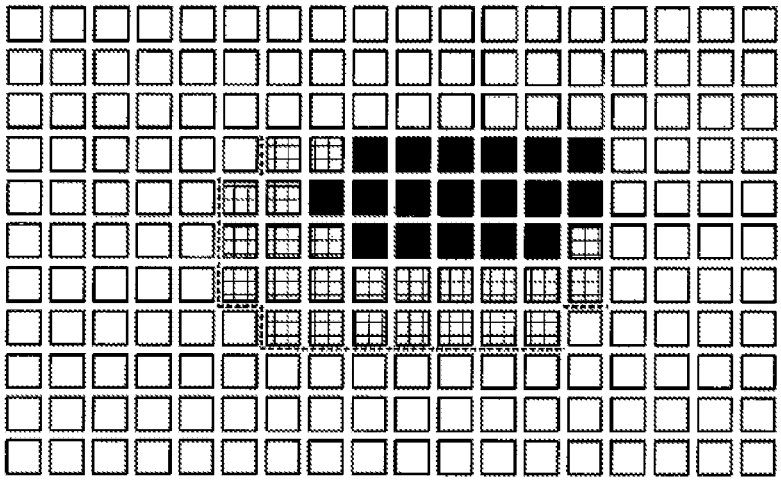
FIG. 14B CORRECTION PROCESSING (LOW POTENTIAL TWO PIXELS, $\theta b = 90^\circ$)
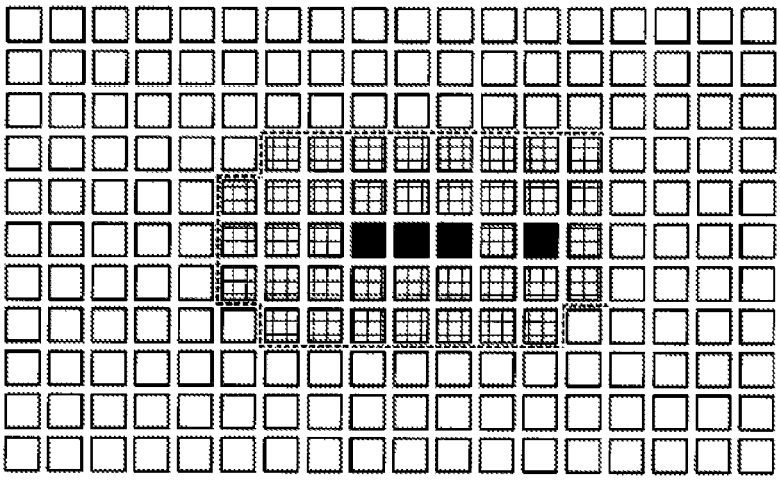
FIG. 14C CORRECTION PROCESSING (LOW POTENTIAL TWO PIXELS, $\theta b = 225^\circ$)
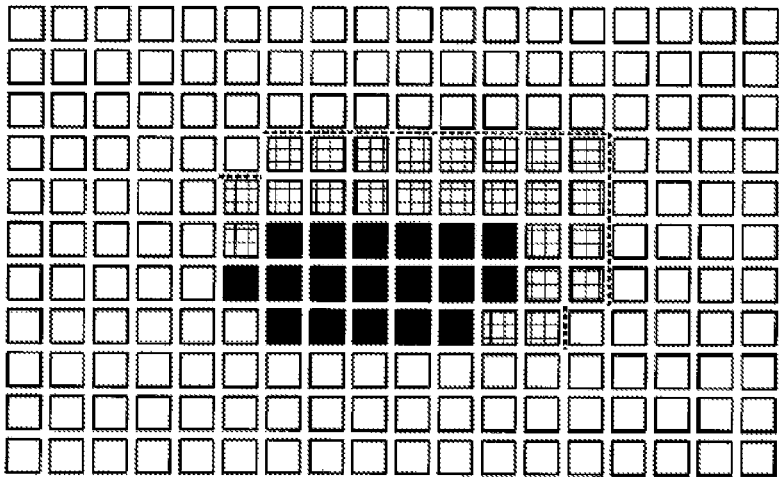

FIG. 16A CORRECTION PROCESSING (HIGH POTENTIAL ONE PIXEL, $\theta b = 45^\circ$)
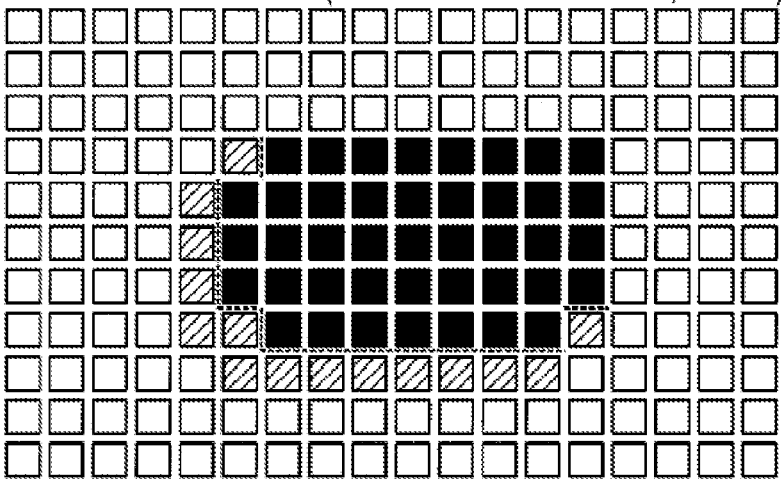
FIG. 16B CORRECTION PROCESSING (HIGH POTENTIAL ONE PIXEL, $\theta b = 90^\circ$)
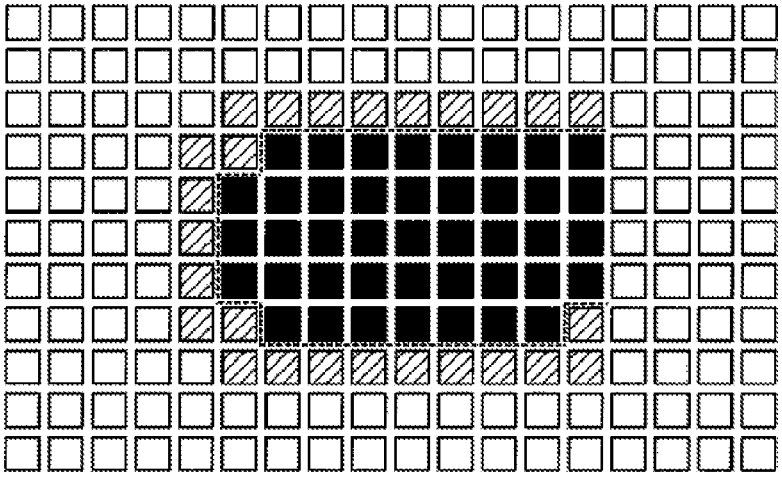
FIG. 16C CORRECTION PROCESSING (HIGH POTENTIAL ONE PIXEL, $\theta b = 225^\circ$)
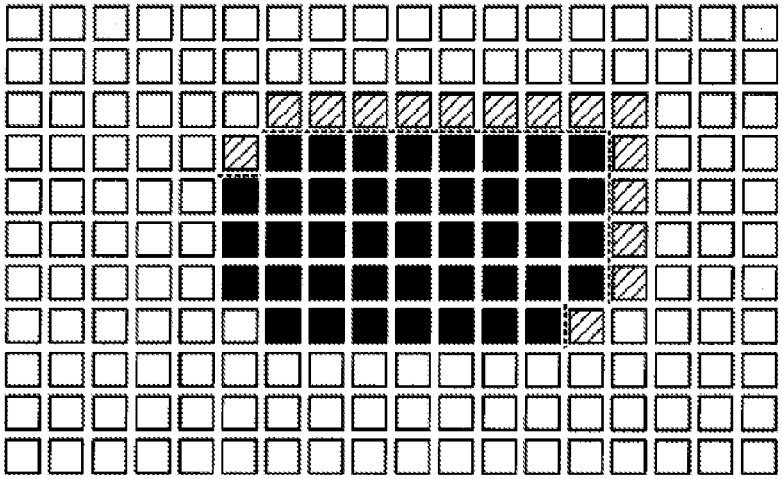

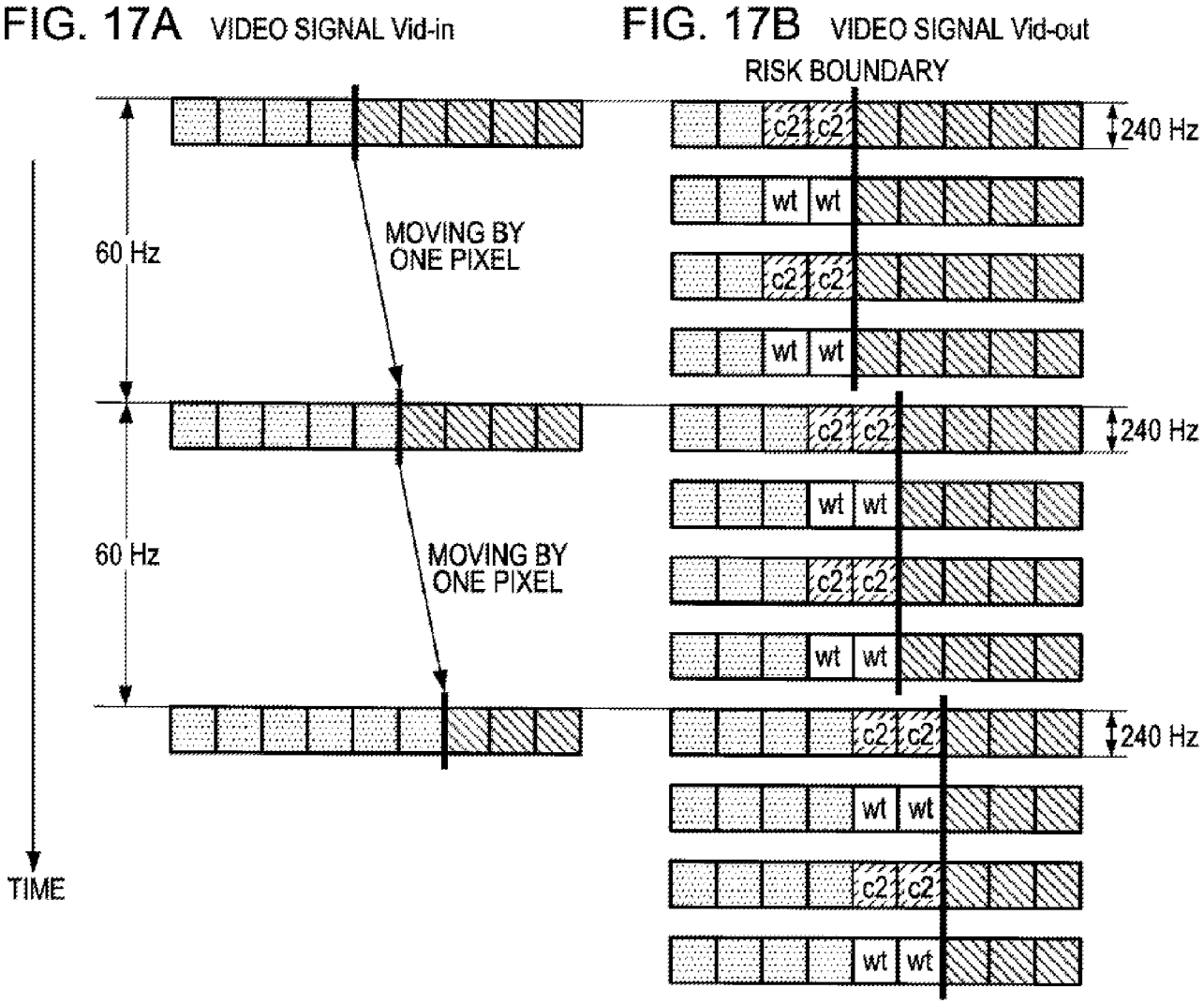
FIG. 17A VIDEO SIGNAL Vid-in
FIG. 17B VIDEO SIGNAL Vid-out
RISK BOUNDARY
240 Hz
240 Hz
240 Hz
60 Hz
60 Hz
MOVING BY ONE PIXEL
MOVING BY ONE PIXEL
c2
wt
TIME CORRECTION PROCESSING (HIGH POTENTIAL TWO PIXEL, $\theta b = 45^\circ$)

CORRECTION PROCESSING (HIGH POTENTIAL TWO PIXEL, $\theta b = 90^\circ$)

CORRECTION PROCESSING (HIGH POTENTIAL TWO PIXEL, $\theta b = 225^\circ$)

VIDEO SIGNAL Vid-in

VIDEO SIGNAL Vid-out
RISK BOUNDARY
240 Hz
240 Hz
240 Hz
wt
c1
c2
bk
MOVING BY ONE PIXEL
MOVING BY ONE PIXEL
60 Hz
60 Hz
TIME CORRECTION PROCESSING (LOW + HIGH POTENTIAL SIDE ONE PIXEL, $\theta b = 45^\circ$)

CORRECTION PROCESSING (LOW + HIGH POTENTIAL SIDE ONE PIXEL, $\theta b = 90^\circ$)

CORRECTION PROCESSING (LOW + HIGH POTENTIAL SIDE ONE PIXEL, $\theta b = 225^\circ$)

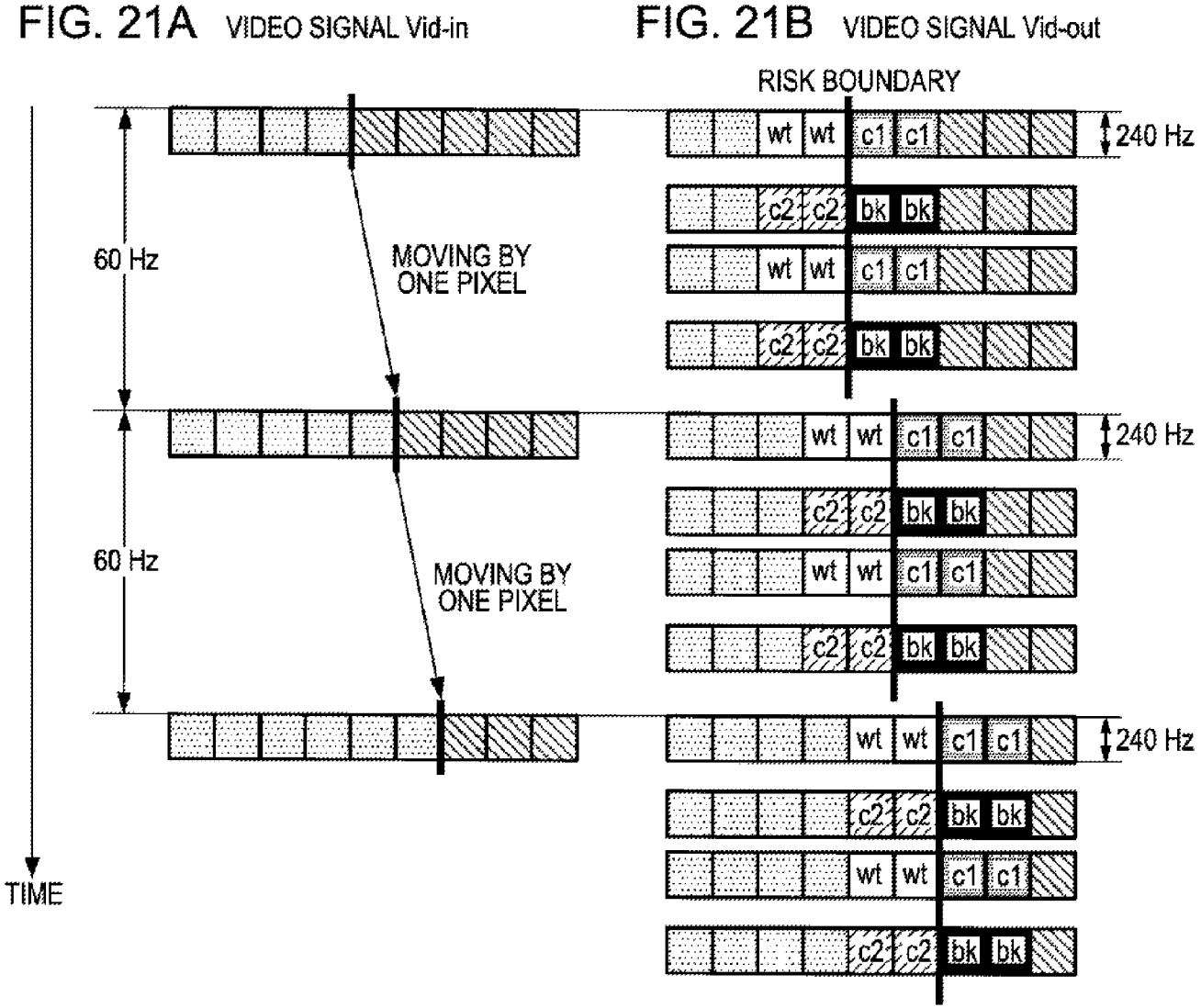
FIG. 21A VIDEO SIGNAL Vid-in
FIG. 21B VIDEO SIGNAL Vid-out
RISK BOUNDARY
240 Hz
240 Hz
240 Hz
60 Hz
60 Hz
MOVING BY ONE PIXEL
MOVING BY ONE PIXEL
wt
c1
c2
bk
TIME FIG. 22A CORRECTION PROCESSING (LOW + HIGH POTENTIAL SIDE TWO PIXEL, $\theta b = 45^\circ$)
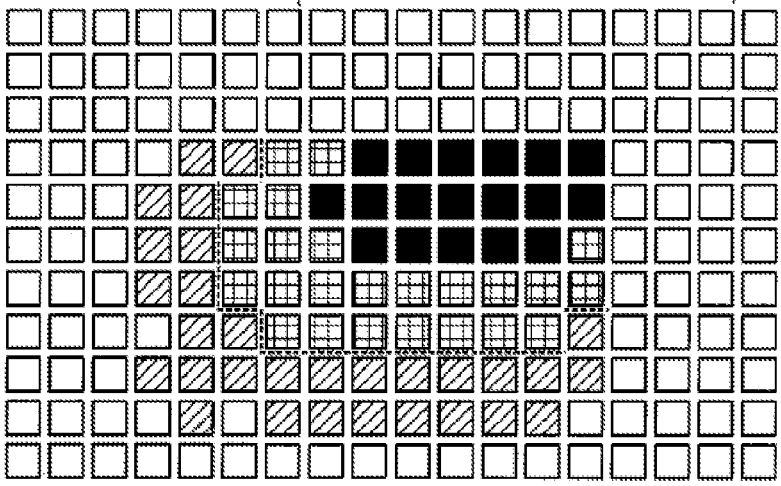
FIG. 22B CORRECTION PROCESSING (LOW + HIGH POTENTIAL SIDE TWO PIXEL, $\theta b = 90^\circ$)
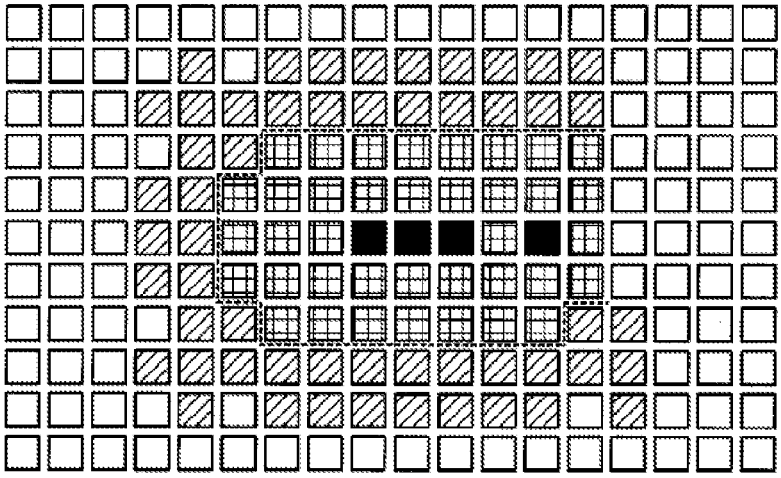
FIG. 22C CORRECTION PROCESSING (LOW + HIGH POTENTIAL SIDE TWO PIXEL, $\theta b = 225^\circ$)
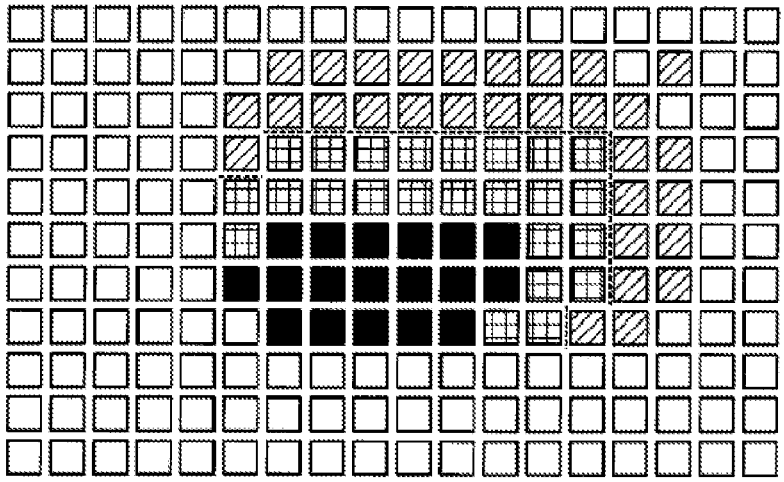

FIG. 24A DETECTING BOUNDARY (PREVIOUS FRAME)
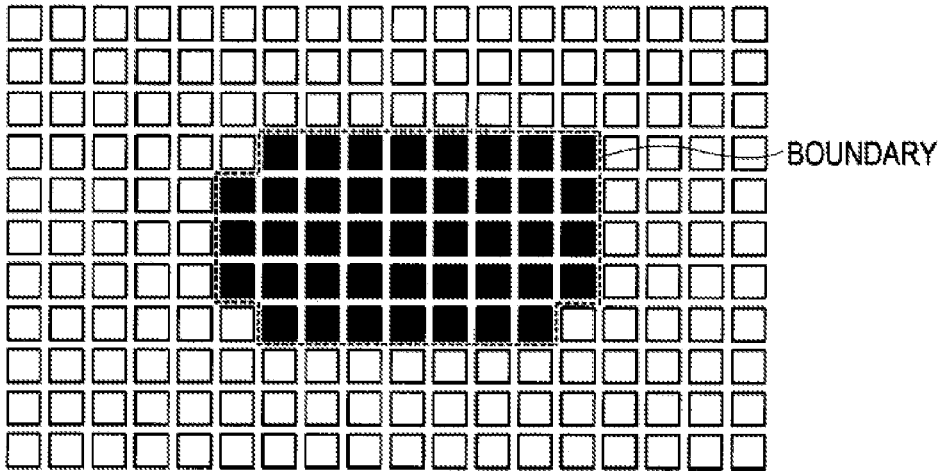
FIG. 24B DETECTING BOUNDARY (CURRENT FRAME)
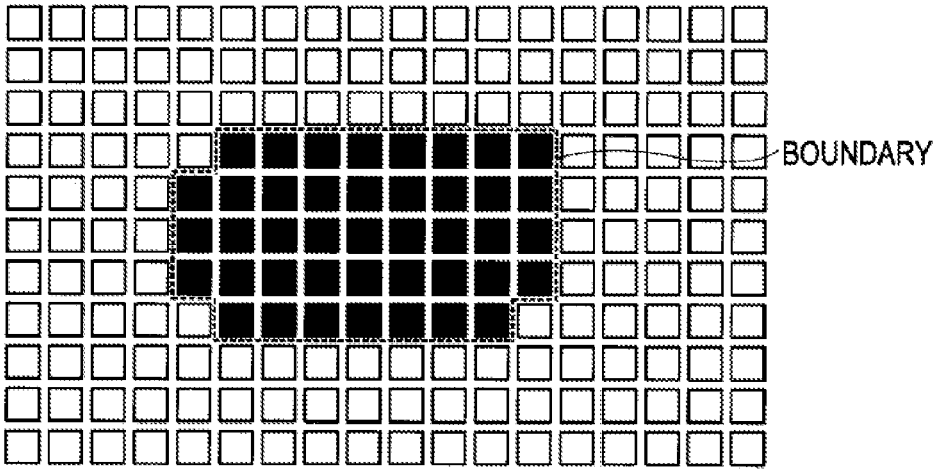
FIG. 24C DETECTING APPLYING BOUNDARY
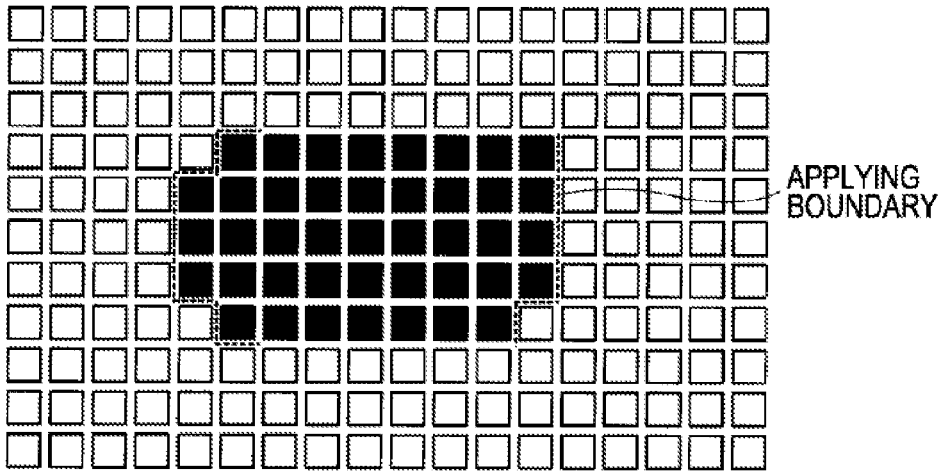

FIG. 25A RISK BOUNDARY + DETECTING APPLYING BOUNDARY ($\theta b = 45^\circ$)
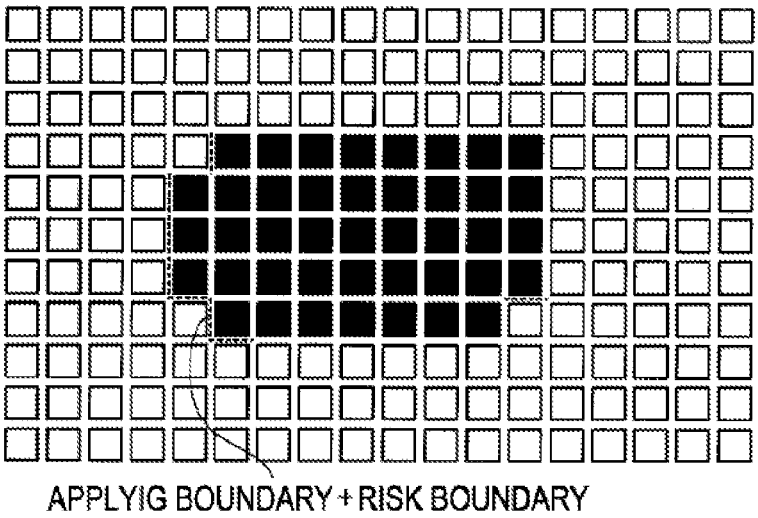
FIG. 25B CORRECTION PROCESSING
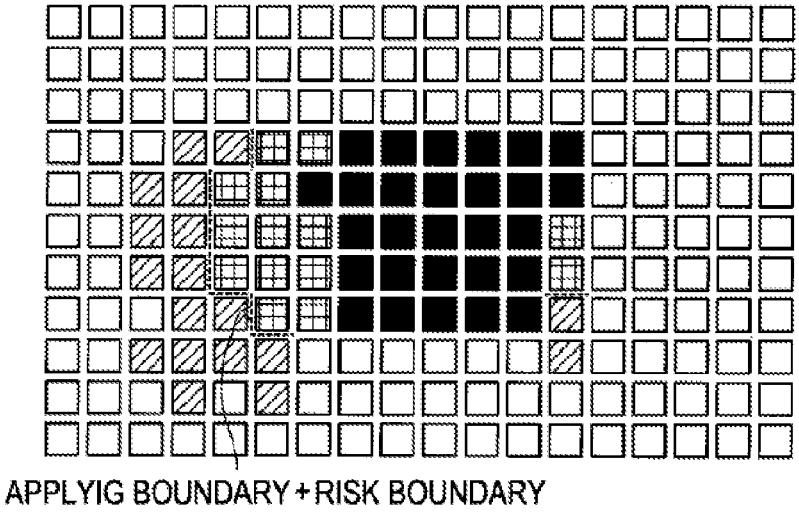

VIDEO SIGNAL Vid-in

VIDEO SIGNAL Vid-out
RISK BOUNDARY
240 Hz
240 Hz
240 Hz
MOVING BY ONE PIXEL
MOVING BY ONE PIXEL
60 Hz
60 Hz
TIME VIDEO SIGNAL Vid-in VIDEO SIGNAL Vid-out
PIXEL P
240 Hz
240 Hz
240 Hz
MOVING BY ONE PIXEL
MOVING BY ONE PIXEL
60 Hz
60 Hz
TIME

CASE OF ADOPTING INTERMEDIATE GRAYSCALE

AVAILABLE RANGE

| VOLTAGE CORRESPONDING TO CORRECTION GRAYSCALE [V] | VOLTAGE CORRESPONDING TO ORIGINAL GRAYSCALE [V] | | | | | | | | | |
|---|---|---|---|---|---|---|---|---|---|---|
| | 2.824 | 2.51 | 2.196 | 1.882 | 1.569 | 1.255 | 0.941 | 0.627 | 0.314 | 0 |
| 2.824 | 62.5 | 49.01 | 35.75 | 24.41 | 15.81 | 10.01 | 6.462 | 4.503 | 3.536 | 3.249 |
| 2.51 | | 34.3 | 21.3 | 11.7 | 5.865 | 2.867 | 1.518 | 0.957 | 0.719 | 0.64 |
| 2.196 | | | 10.7 | 4.348 | 1.613 | 0.67 | 0.35 | 0.23 | 0.18 | 0.16 |
| 1.882 | | | | 1.37 | 0.46 | 0.207 | 0.119 | 0.084 | 0.067 | 0.06 |
| 1.569 | | | | | 0.18 | 0.091 | 0.054 | 0.038 | 0.03 | 0.027 |
| 1.255 | | | | | | 0.049 | 0.029 | 0.019 | 0.016 | 0.013 |
| 0.941 | | | | | | | 0.018 | 0.011 | 0.007 | 0.006 |
| 0.627 | | | | | | | | 0.006 | 0.004 | 0.002 |
| 0.314 | | | | | | | | | 0.001 | 0.001 |
| 0 | | | | | | | | | | 0 |

VIDEO PROCESSING CIRCUIT, VIDEO PROCESSING METHOD, LIQUID CRYSTAL DISPLAY DEVICE, AND ELECTRONIC APPARATUS

BACKGROUND

1. Technical Field

The present invention relates to a technology in which a defect when performing a display on a liquid crystal panel is reduced.

2. Related Art

A liquid crystal panel has a configuration in which liquid crystal is interposed between a pixel electrode which is provided in each pixel and a common electrode which is provided in common in a plurality of pixels. In such a liquid crystal panel, an alignment defect in the liquid crystal (reverse tilt domains) due to a transverse electric field which is generated between pixel electrodes which are adjacent to each other occurs, and there are cases in which the alignment defect causes a defect when performing a display. Technology which suppresses occurrence of the defect due to the alignment defect in the liquid crystal when performing a display is disclosed in JP-A-2009-237366 and JP-A-2010-191157. In JP-A-2009-237366, and JPA-2010-191157, technology is disclosed in which a transverse electric field, which is generated in a pixel in which a defect in video quality easily occurs due to a vapor deposition direction in an alignment of liquid crystal (inorganic alignment film) among pixels to which the transverse electric field is strongly applied, is reduced.

Meanwhile, a defective display which is caused to a pixel as a correction target is easier to be perceived by a user, when a value in which an amount of change in transmittance of a liquid crystal element due to an application of a correction voltage is subjected to time integration using an applying time is larger. In the technology which is disclosed in JP-A-2009-237366, and JP-A-2010-191157, since a constant correction voltage is applied over the entire period of one frame in the pixel as a correction target, it is considered that the defective display which is perceived by a user easily occurs.

SUMMARY

An advantage of some aspects of the present invention is to reduce reverse tilt domain by suppressing a change in transmittance of a liquid crystal element due to an application of a correction voltage in each frame.

According to an aspect of the invention, there is provided a driving unit of a liquid crystal device which is a driving unit driving the liquid crystal device having a plurality of pixels, including the functions of generating a first voltage based on a first video signal which is designated by a first grayscale corresponding to a first pixel among the plurality of pixels; generating a third voltage corresponding to a third grayscale, and a fourth voltage corresponding to a fourth grayscale based on a second video signal which designates a second grayscale corresponding to a second pixel which is adjacent to the first pixel; supplying the first voltage to the first pixel, and supplying the third voltage to the second pixel in a first period; and supplying the fourth voltage to the second pixel in a second period, in which one of the third voltage and the fourth voltage is higher than the second voltage corresponding to the second grayscale, and the other is lower than the second voltage.

According to the aspect of the invention, it is possible to reduce the reverse tilt domain by suppressing a change in transmittance of a liquid crystal element due to an application of a correction voltage in each frame.

According to another aspect of the invention, there is provided a driving unit which drives the liquid crystal device having the plurality of pixels, including the functions of generating the third voltage corresponding the third grayscale, and the fourth voltage corresponding to the fourth grayscale based on the first video signal which designates the first grayscale corresponding to the first pixel among the plurality of pixels; generating a fifth voltage corresponding a fifth grayscale, and a sixth voltage corresponding to a sixth grayscale based on a second video signal which designates the second grayscale corresponding to the second pixel which is adjacent to the first pixel; supplying the third voltage to the first pixel, and the fifth voltage to the second pixel in the first period; supplying the fourth voltage to the first pixel, and the sixth voltage to the second pixel in the second period, and in which one of the third voltage and fourth voltage is higher than the first voltage corresponding to the first grayscale, and the other is lower than the first voltage, and one of the fifth voltage and sixth voltage is higher than the second voltage corresponding to the second grayscale, and the other is lower than the second voltage.

According to the aspect of the invention, it is possible to reduce the reverse tilt domain by suppressing the change in transmittance of the liquid crystal element due to the application of correction voltage in each frame.

In the driving unit according to the aspect of the invention, a correction unit may designate a video signal designating an application voltage to a liquid crystal element corresponding to the second pixel which is adjacent to a boundary which is detected by a boundary detection unit to a correction voltage which is higher than the application voltage in a part of a period of one frame, and correct the video signal as a video signal which designates a correction voltage which is lower than the application voltage in other periods of the period of one frame.

According to the aspect of the invention, it is possible to increase an effect of reducing the reverse tilt domain by making a difference in potential between the first pixel and second pixel which are adjacent to each other smaller.

In the driving unit according to the aspect of the invention, the correction unit may set a period of correcting the video signal to the video signal which designates the high correction voltage with respect to the first pixel, and a period of correcting the video signal to the video signal which designates the high correction voltage with respect to the second pixel to the same period of time.

According to the aspect of the invention, it is possible to prevent a transverse electric field which is applied between the first pixel and second pixel which are adjacent to each other from becoming strong in a period of time in which a period of time in which a high correction voltage is applied to the first pixel, and a period of time in which a high correction voltage is applied to the second pixel are not overlapped with each other.

In the driving unit according to the aspect of the invention, the correction unit may correct the video signal of the first pixel which comes into contact with the boundary by setting the lowest voltage which is used when expressing the grayscale as the low correction voltage.

According to the aspect of the invention, it is possible to suppress the occurrence of defective display, even when the correction voltage of the first pixel is set to be high in order to increase the effect of reducing the reverse tilt domain.

In the driving unit according to the aspect of the invention, the correction unit may correct the video signal of the second pixel which comes into contact with a boundary by setting the maximum voltage which is used when expressing the grayscale as the high correction voltage.

According to the aspect of the invention, it is possible to suppress the occurrence of defective display, even when the correction voltage of the second pixel is set to be low in order to increase the effect of reducing the reverse tilt domain.

In the driving unit according to the aspect of the invention, the correction unit may correct the video signal to a video signal which designates a constant correction voltage regardless of the application voltage which is designated using the input video signal in each of the part of period, and the other periods.

According to the aspect of the invention, an individual correction voltage need not be set according to the application voltage of the liquid crystal element which is designated by the input video signal.

In the driving unit according to the aspect of the invention, the correction unit may correct the video signal so that a change in integrated transmittance in which transmittance of the liquid crystal element is subject to time integration over one frame period, which occurs due to the correction of the video signal, is 1.0% or less.

According to the aspect of the invention, defective display due to the correction of video signal is not easily perceived by a user.

In the driving unit according to the aspect of the invention, the boundary detection unit detects a risk boundary which is a part of a boundary between the first pixel and second pixel, is designated by the input video signal, and is determined by a tilting orientation of the liquid crystal, and the correction unit may set a pixel which comes into contact with the risk boundary which is detected by the boundary detection unit as a correction target.

According to the aspect of the invention, it is possible to correct the video signal by concentrating on pixels in which the reverse tilt domain easily occurs, according to the tilting orientation of the liquid crystal.

In the driving unit according to the aspect of the invention, the boundary detection unit may detect a boundary at which there is a change from a frame which is the immediately previous frame to a current frame, to the current frame, and the correction unit may set a pixel which comes into contact with the changed boundary which is detected by the boundary detection unit as a correction target.

According to the aspect of the invention, it is possible to correct a video signal for reducing the reverse tilt domain by concentrating on the pixel in which the reverse tilt domain easily occurs according to a movement of an image.

In the driving unit according to the aspect of the invention, the correction unit may set the pixel which comes into contact with the boundary at which only one pixel moves from a previous frame to a current frame as a correction target, among the changed boundaries.

According to the aspect of the invention, it is possible to correct the video signal for reducing the reverse tilt domain by concentrating on the pixel in which the reverse tilt domain easily occurs according to a movement of an image.

In addition, the invention can also be conceived as a video processing method, a liquid crystal display device, and an electronic apparatus including the liquid crystal display device, in addition to the video processing circuit.

BRIEF DESCRIPTION OF THE DRAWINGS

The invention will be described with reference to the accompanying drawings, wherein like numbers reference like elements.

FIG. 7 is a diagram which illustrates a measurement result of a change in transmittance between the original grayscale and a correction grayscale.

FIGS. 9A and 9B are explanatory diagrams which illustrate a detection order at a risk boundary in the video processing circuit.

FIGS. 10A to 10C are diagrams which illustrate the correction processing in the video processing circuit.

FIGS. 14A to 14C are diagrams which illustrate the correction processing in the video processing circuit.

FIGS. 16A to 16C are diagrams which illustrate the correction processing in the video processing circuit.

FIGS. 17A and 17B are diagrams which schematically describe correction processing in a video processing circuit according to a fourth embodiment in the invention.

FIGS. 21A and 21B are diagrams which schematically describe correction processing in a video processing circuit according to a sixth embodiment in the present invention.

FIGS. 22A to 22*c* are diagrams which illustrate the correction processing in the video processing circuit.

FIGS. 24A to 24C are explanatory diagrams which illustrate a detection order of a risk boundary in the video processing circuit.

FIGS. 25A and 25B are explanatory diagrams which illustrate the detection order of the risk boundary, and correction processing in the video processing circuit.

DESCRIPTION OF EXEMPLARY EMBODIMENTS

Hereinafter, embodiments of the present invention will be described with reference to drawings.

First Embodiment

First, a first embodiment of the present invention will be described.

Figure 1:
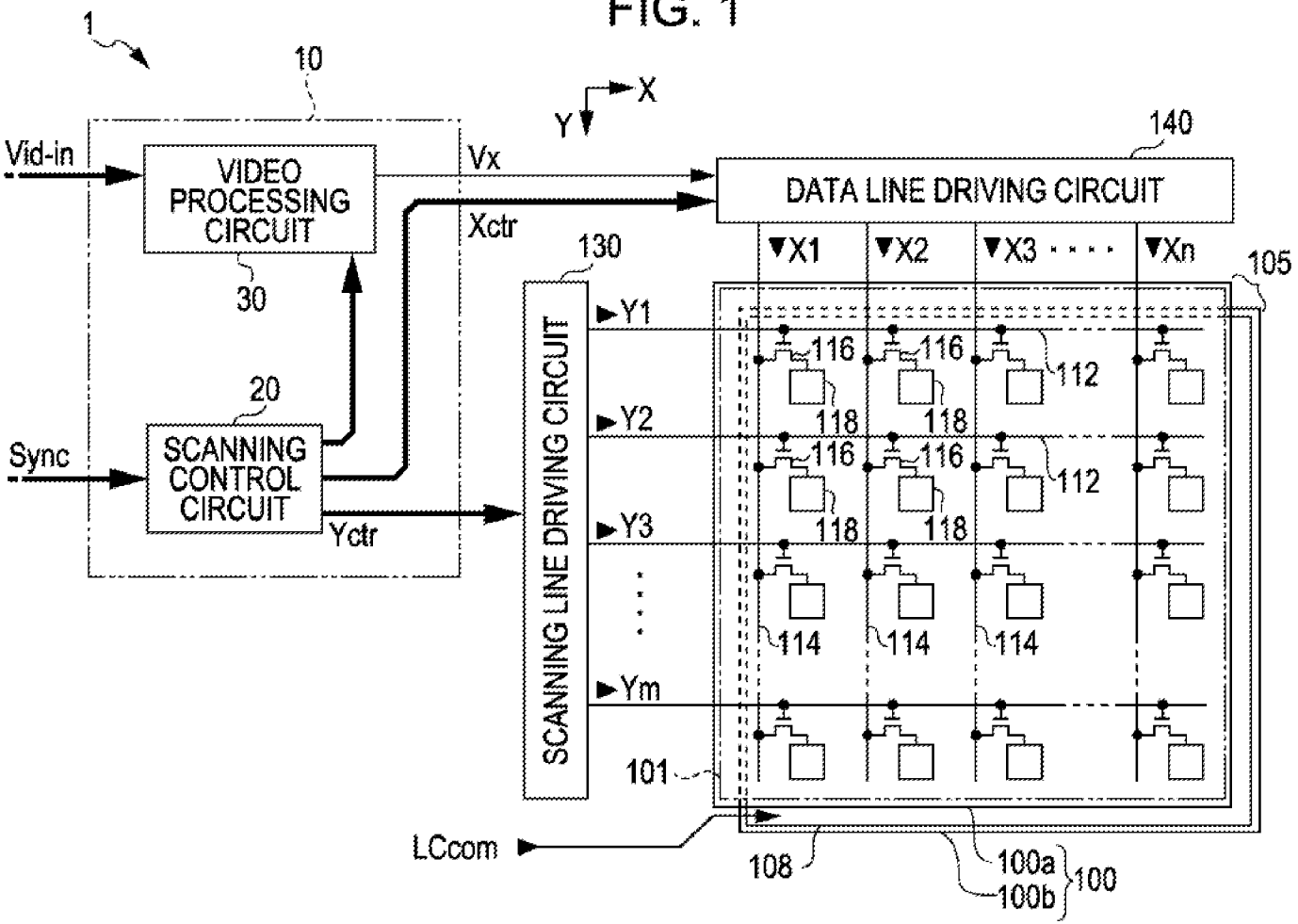
FIG. 1 is a diagram which illustrates a liquid crystal display device to which a video processing circuit according to a first embodiment of the invention has been applied.

FIG. 1 is a block diagram which illustrates an overall configuration of a liquid crystal display device 1 to which a video processing circuit according to the embodiment is applied.

As illustrated in FIG. 1, the liquid crystal display device 1 includes a control circuit 10, a liquid crystal panel 100, a scanning line driving circuit 130, and a data driving circuit 140. A video signal Vid-in is supplied to the control circuit 10 from a host device by being synchronized with a synchronous signal Sync. The video signal Vid-in is digital data which designates grayscale levels of each of pixels, respectively, in the liquid crystal panel 100, and is supplied in an order of scanning corresponding to a vertical scanning signal included in the synchronous signal Sync, a horizontal scanning signal, and a dot clock signal (none of these are shown). According to the embodiment, a frequency of supplying the video signal Vid-in is 60 Hz, and a video signal Vid-in for displaying an image of one frame (one frame) at a cycle of 16.67 milliseconds as a reciprocal number thereof.

In addition, the video signal Vid-in designates a grayscale level, however, since an application voltage of a liquid crystal element is determined according to the grayscale level, it is possible to regard the video signal Vid-in as a signal which designates the application voltage of the liquid crystal element. In descriptions below, it is set such that the higher the grayscale level of a video signal, the larger the application voltage to be designated with respect to a liquid crystal element.

The control circuit 10 includes a scanning control circuit 20, and a video processing circuit 30. The scanning control circuit 20 generates various control signals, and controls each unit by being synchronized with the synchronous signal Sync. The video processing circuit 30 processes a digital video signal Vid-in, and outputs an analog data signal Vx, though it will be described in detail later.

In the liquid crystal panel 100, an element substrate (first substrate) 100*a*, and an opposing substrate (second substrate) 100*b* are joined together with a certain gap, and liquid crystal 105 which is driven by a vertical electric field is interposed between the gap. In the element substrate 100*a*, on the opposing surface to the opposing substrate 100*b*, scanning lines 112 of a plurality of m rows are provided along the X (horizontal) direction in the figure. On the other hand, data lines 114 of a plurality of n columns are provided along the Y (vertical) direction so as to be electrically insulated from the respective scanning lines 112 each other.

In addition, according to the embodiment, there is a case in which the rows are referred to as 1, 2, 3, . . . , (m−1), and mth row in order from above in the figure in order to differentiate the scanning lines 112 from the data lines. Similarly, there is a case in which the rows are referred to as 1, 2, 3, . . . , (n−1), and nth column in order from the left in the figure in order to differentiate the data lines 114 from the scanning lines.

In the element substrate 100*a*, a set of an n-channel TFT 116 and a rectangular pixel electrode 118 which is transparent is further provided by corresponding to each of intersections of the scanning lines 112 and the data lines 114. In the TFT 116, a gate electrode is connected to the scanning line 112, a source electrode is connected to the data line 114, and a drain electrode is connected to the pixel electrode 118. On the other hand, in the opposing substrate 100*b*, common electrodes 108 which are transparent are provided on the whole opposing surface of the element substrate 100*a*. A voltage LCcom is applied to the common electrode 108 through a circuit which is not shown.

In addition, in FIG. 1, since the opposing surface of the element substrate 100*a* is the rear surface of paper, the scanning line 112, the data line 114, the TFT 116, and the pixel electrode 118 are to be denoted by dashed lines, however, they are denoted by solid lines, respectively, in order to be easily viewed.

Figure 2:
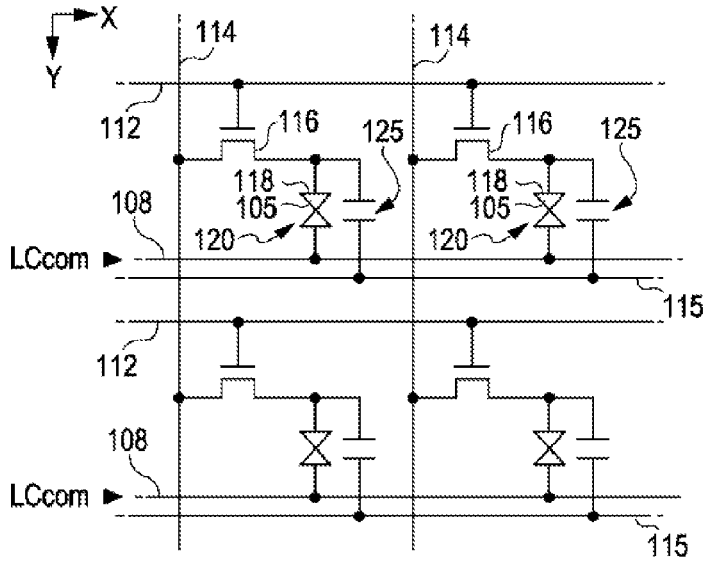
FIG. 2 is a diagram which illustrates an equivalent circuit of a liquid crystal element in the liquid crystal display device.

FIG. 2 is a diagram which illustrates an equivalent circuit in the liquid crystal panel 100.

As illustrated in FIG. 2, the liquid crystal panel 100 has a configuration in which a liquid crystal element 120 which interposes a liquid crystal 105 between the pixel electrode 118 and the common electrode 108 corresponding to intersection of the scanning line 112 and the data line 114. In the equivalent circuit in the liquid crystal panel 100, though it is omitted in FIG. 1, as illustrated in FIG. 2, in practice, an auxiliary capacity (storage capacity) 125 is provided in parallel with respect to the liquid crystal element 120. One end of the auxiliary capacity 125 is connected to the pixel electrode 118, and the other end is connected to a capacity line 115 in common. The capacity line 115 is maintained to a constant voltage in terms of time.

Here, when the scanning line 112 becomes a high level, the TFT 116 of which the gate electrode is connected to the scanning line is in ON state, and the pixel electrode 118 is connected to the data line 114. For this reason, when a data signal of a voltage corresponding to a grayscale is supplied to the data line 114 at the time when the scanning line 112 is the high level, the data signal is applied to the pixel electrode 118 through the TFT 116 which is in ON state. When the scanning line 112 is a low level, the TFT 116 is turned off, however, the voltage which is applied to the pixel electrode 118 is maintained due to a capacitive property of the liquid crystal element 120, and the auxiliary capacity 125.

In the liquid crystal element 120, an alignment state of molecules in the liquid crystal 105 is change according to an electric field which is generated by the pixel electrode 118 and the common electrode 108. For this reason, when the liquid crystal display device is a transmission type, the transmittance of the liquid crystal element 120 becomes transmittance corresponding to an applying/maintaining voltage. In the liquid crystal panel 100, since the transmittance is changed in each liquid crystal element 120, the liquid crystal element 120 corresponds to the pixel. In addition, an arranging region of the pixel becomes a display area 101.

In addition, according to the embodiment, the normally black mode is set in which the liquid crystal 105 is set to the VA method, and the liquid crystal element 120 becomes a black state when a voltage is not applied.

Figures 5A, 5B:
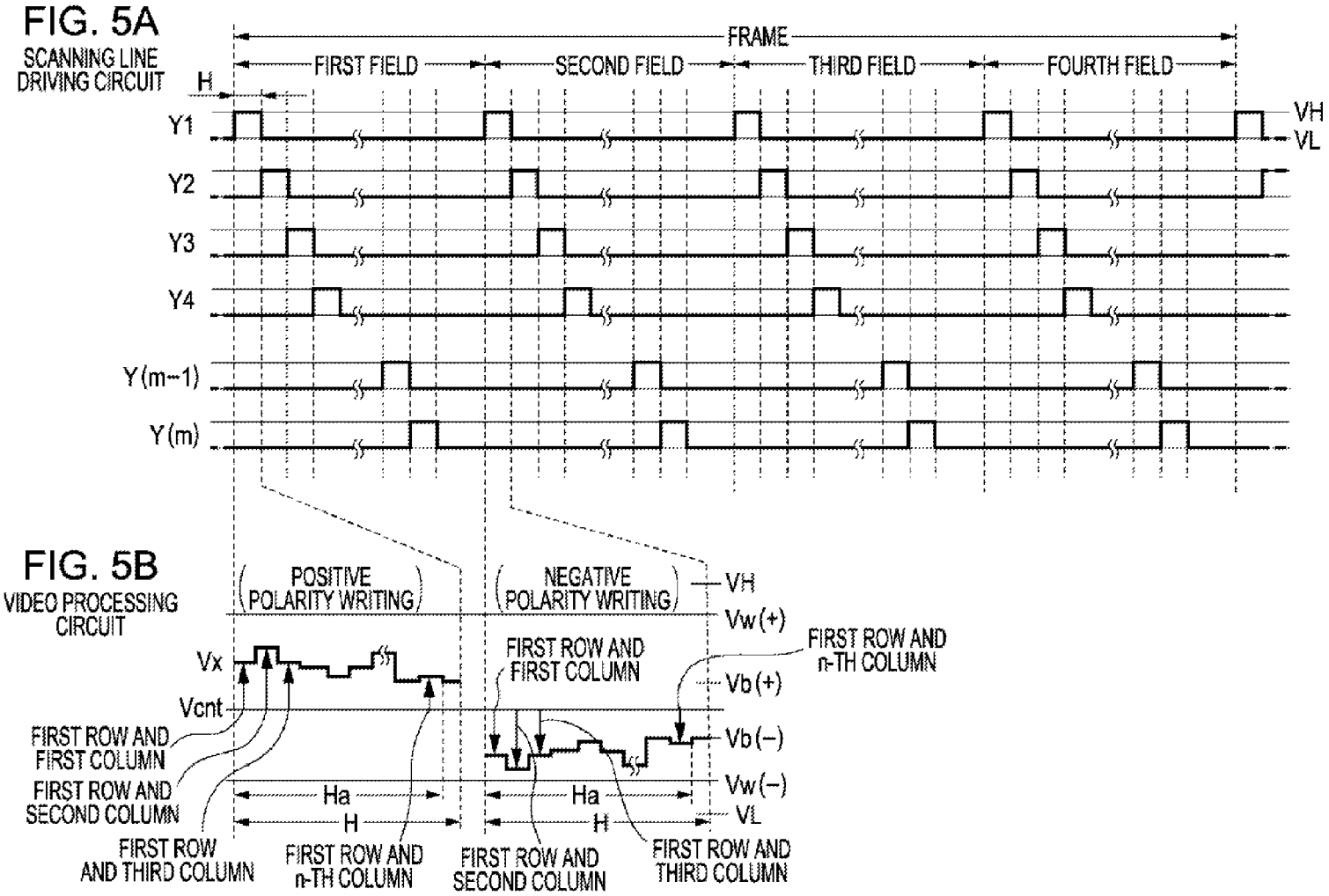
FIGS. 5A and 5B are diagrams which illustrate display operations in the liquid crystal panel.

Returning to FIG. 1, the scanning line driving circuit 130 supplies scanning signals Y1, Y2, Y3, . . . , Ym to the scanning lines 112 of first, second, third, . . . , mth row according to a control signal Yctr by the scanning control circuit 20. More specifically, as illustrated in FIG. 5A, the scanning line driving circuit 130 selects the scanning line 112 in the order of first, second, third, . . . , (m−1)th, mth row over one frame, sets a scanning signal to a selected scanning line to a selection voltage VH (H level), and sets scanning signals to other scanning lines than that to a non-selection voltage VL (L level).

In addition, the frame means a period which is necessary for displaying an image of one frame on the liquid crystal panel 100 by driving the liquid crystal panel 100. According to the embodiment, a frequency of a vertical scanning signal which is controlled by the synchronous signal Sync is 240 Hz. As illustrated in FIG. 5A, in the liquid crystal display device 1 according to the embodiment, one frame is divided into four fields of a first field to fourth field, respectively, and so-called quad-speed driving in which first to mth scanning lines are scanned in each field is executed. That is, an image of one frame is displayed based on the video signal Vid-in when the liquid crystal display device 1 drives the liquid crystal panel 100 at a driving speed of 240 Hz based on the video signal Vid-in which is supplied at a supply speed of 60 Hz from the host device. The period in one field corresponds to ¼ frame period, and it becomes approximately 4.16 milliseconds here. In addition, as illustrated in FIG. 5B, in the liquid crystal display device 1, positive polarity writing is designated in the first and third fields, negative polarity writing is designated in the second and fourth fields, writing polarity is reversed in each frame, thereby performing data writing to pixels.

The data line driving circuit 140 performs sampling of the data signal Vx which is supplied from the video processing circuit 30 as data signals X1 to Xn which are applied to the data lines 114 of first to nth row according to a control signal Xctr from the scanning control circuit 20.

In addition, in the description, regarding the voltage, excepting for the application voltage of the liquid crystal element 120, a ground potential which is not shown is set as a reference of zero voltage as long as it is not particularly specified. The application voltage of the liquid crystal element 120 is a difference in potential between voltage LCcom of the common electrode 108 and the pixel electrode 118, and it is for differentiating the application voltage from other voltages.

Figure 4A:
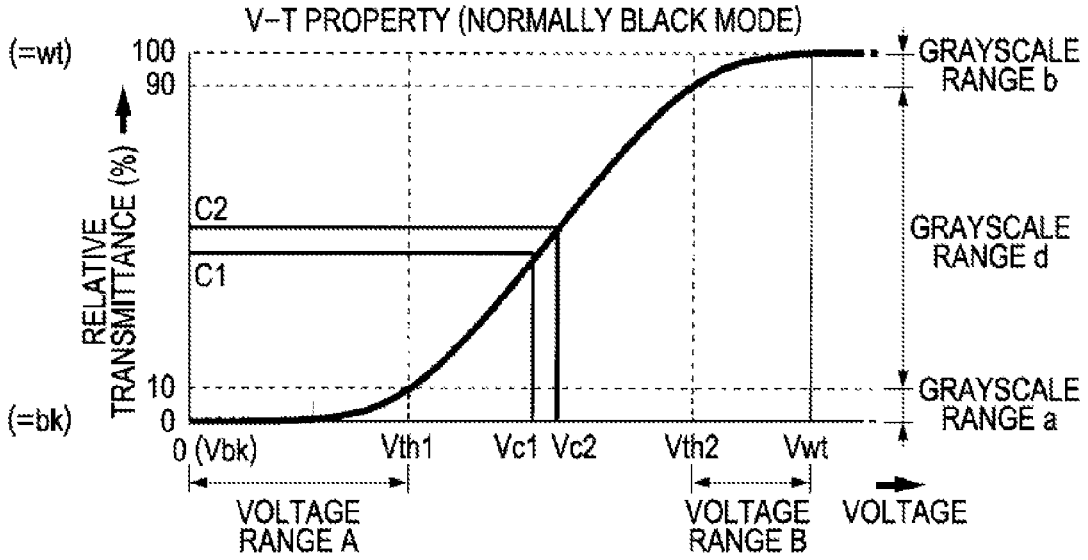
FIGS. 4A and 4B are diagrams which illustrate the V-T property of a liquid crystal panel which configures the liquid crystal display device.

Meanwhile, when a mode is the normally black mode, a relationship between the application voltage and the transmittance of the liquid crystal element 120 is denoted by a V-T property as illustrated in FIG. 4A, for example. For this reason, in order to make the liquid crystal element 120 have transmittance according to a grayscale level which is designated using the video signal Vid-in, a voltage corresponding to the grayscale level is to be applied to the liquid crystal element 120. However, there is a case in which a defective display due to the reverse tilt domain occurs when the application voltage of the liquid crystal element 120 is simply defined according to the grayscale level which is designated using the video signal Vid-in.

An example of a defective display due to the reverse tilt domain will be described. For example, as illustrated in FIG. 28, when in an image which is denoted by the video signal Vid-in in which a black pattern in which black pixels are continuous having white pixels as a background is moved to the right by one pixel in each frame, pixels to be changed to white pixels from black pixels in the left end edge portion (rear edge portion of movement) of the black pattern do not change to the white pixels due to an occurrence of the reverse tilt domain.

In addition, when an area of the black pixels having the white pixels as the background moves by two pixels or more in each frame in the liquid crystal panel 100, if a response time of the liquid crystal element is shorter than a time interval in which a display screen is updated (that is, one frame period), such tailing is not actualized (or, hardly visible). The reason why can be considered as follows. That is, the reason is that in a certain frame, when the white pixels and black pixels are adjacent to each other, the reverse tilt domain may occur in the white pixels, however, when considering a movement of an image, pixels at which the reverse tilt domain occurs are discrete, and the reverse tilt domain does not attract attention visually.

Figure 28:
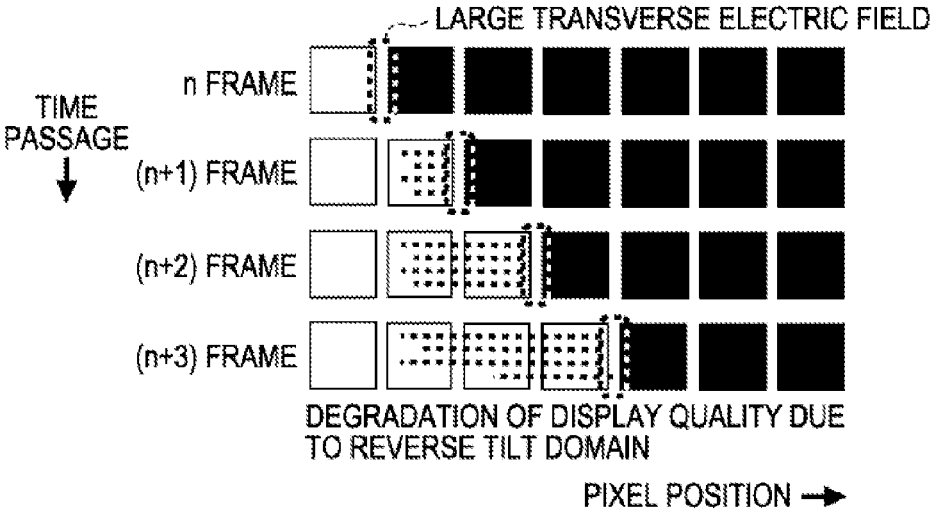
FIG. 28 is a diagram which illustrates a defective display or the like which is affected by a transverse electric field.

In addition, when changing a viewpoint in FIG. 28, it is also possible that, in a case where a white pattern in which the white pixels are continuous having the black pixels as a background is moved to the right by one pixel in each frame, pixels to be changed to white pixels from black pixels in the right end edge portion (front end portion of movement) of the white pattern do not change to the white pixels due to the occurrence of the reverse tilt domain. In addition, in FIG. 28, for convenience of description, a vicinity of a boundary of one line is extracted.

As one reason for the defective display due to the reverse tilt domain, it is considered that, when the interposed liquid crystal molecules are in an unstable state in the liquid crystal element 120, the interposed liquid crystal molecules fall into disorder by being influenced by the transverse electric field, and are not in an alignment state corresponding to an application voltage thereafter.

Here, the case of being influenced by the transverse electric field is a case in which a difference in potential between pixel electrodes which are adjacent to each other is large, and is a case in which a dark pixel of the black level (or, close to black level), and a light pixel of the white level (or, close to white level) are adjacent to each other in an image to be displayed.

In these, the dark pixel is a pixel of the liquid crystal element 120 when the application voltage is in a voltage range A which is a voltage Vbk of the black level in the normally black mode, and goes below a threshold Vth1 (first voltage). In addition, for convenience, a range of transmittance (grayscale range) of a liquid crystal element of which the application voltage is in the voltage range A is set to "a".

Subsequently, the light pixel is a pixel of the liquid crystal element 120 when the application voltage is in a voltage range B which is a threshold Vth2 (second voltage) or more, and a voltage Vwt or less of the white level in the normally black mode. For convenience, a range of transmittance (grayscale range) of the liquid crystal element of which the application voltage is in the voltage range B is set to "b".

When it is considered in this manner, a situation can occur in which the reverse tilt domain easily occurs due to an influence of the transverse electric field which is generated when the dark pixel and the light pixel are adjacent to each other due to a movement of an image. However, when checking considering the initial aligning state of the liquid crystal molecules, there are cases in which the reverse tilt domain occurs, and does not occur according to a positional relationship between the dark pixel and the light pixel.

Figure 6A:
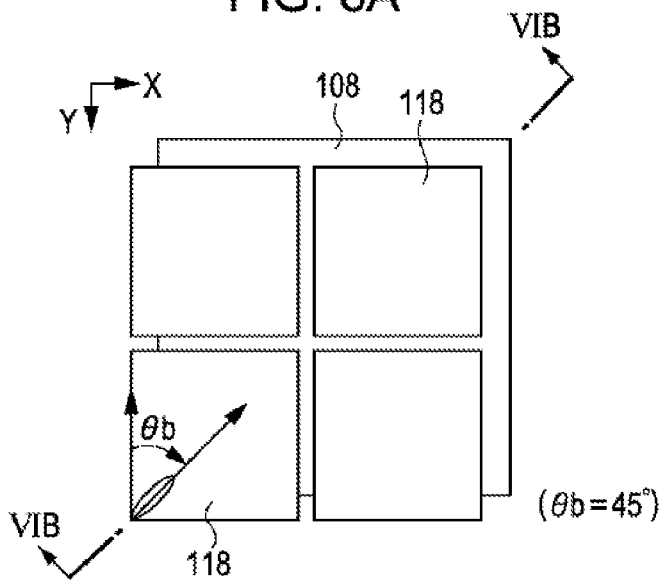
FIGS. 6A to 6C are explanatory diagrams of an initial alignment of the liquid crystal panel when using a VA method.

FIG. 6A is a diagram which illustrates pixels of 2×2 which are adjacent to each other in the vertical direction and the horizontal direction in the liquid crystal panel 100, and FIG.

6B is a simple cross-sectional view of the liquid crystal panel 100 when being cut in a vertical plane including the line VIB-VIB in FIG. 6A.

Figure 6B:
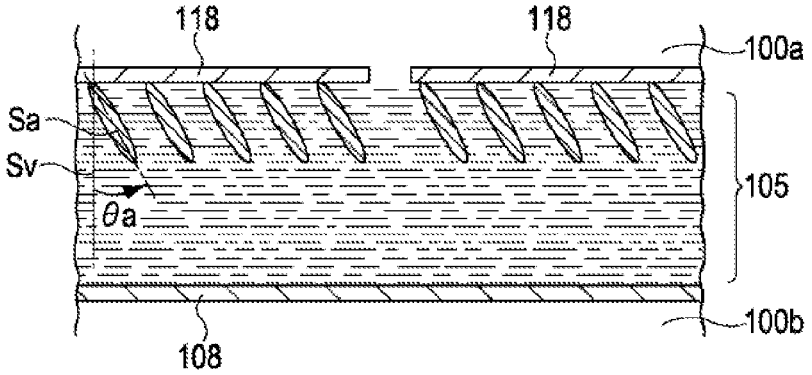
Figure 6C:
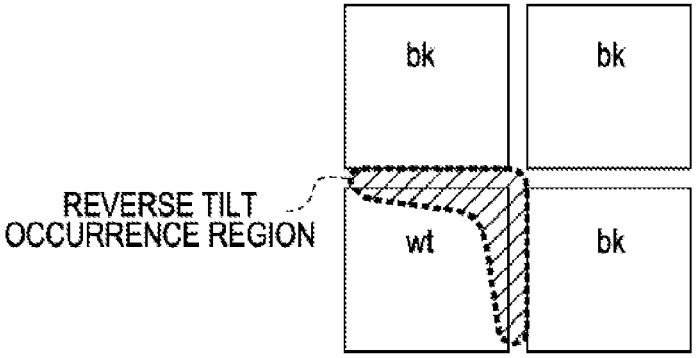

As illustrated in FIGS. 6A to 6C, the liquid crystal molecules of the VA method have a tilt angle of θa, and tilt azimuth of θb (that is, 45°) in a state in which the difference in potential (application voltage of liquid crystal element) between the pixel electrode 118 and the common electrode 108 is zero, and are in a state of an initial alignment. Here, as described above, since the reverse tilt domain occurs due to the transverse electric field between the pixel electrodes 118, a behavior of the liquid crystal molecules on the element substrate 100*a* side to which the pixel electrode 118 is provided is a problem. For this reason, the tilt angle and the tilt azimuth of the liquid crystal molecules are defined by setting the pixel electrode 118 side (element substrate 100*a*) as a reference.

Specifically, as illustrated in FIG. 6B, the tilt angle θa is an angle which is formed by a long axis Sa of the liquid crystal molecules when the other end of the pixel electrode on the common electrode 108 side is tilted by setting an end of the long axis Sa of the liquid crystal molecules on the pixel electrode 118 side as a fixed point by setting a normal line of the substrate Sv as a reference.

On the other hand, the tilt azimuth θb is an angle which is formed by the vertical plane of the substrate (vertical plane including line VIB-VIB) including the long axis Sa of the liquid crystal molecules and the normal line of substrate Sv by setting the vertical plane of the substrate which goes along the Y direction as the arranging direction of the data line 114 as a reference. In addition, the tilt azimuth θb is an angle in which, from the upper direction of a screen (direction opposite to Y direction) to the direction from one end as a starting point to the other end of the long axis of the liquid crystal molecules (upper right direction in FIG. 6A) is defined in clockwise, when planarly viewed from the pixel electrode 118 side toward the common electrode 108.

In addition, similarly, when planarly viewed from the pixel electrode 118 side, the direction from one end of the pixel electrode side to the other end in the liquid crystal molecules is referred to as the downstream side of the tilt azimuth for convenience, and contrarily, the direction from the other end to one end (lower left direction in FIG. 6A) is referred to as the upstream side of the tilt azimuth for convenience.

As disclosed in JP-A-2011-107174, when the tilt azimuth θb is 45° in the liquid crystal of the VA method, as illustrated in FIG. 6A, when only the own pixel is changed to a light pixel from a state in which the liquid crystal molecules are unstable in the own pixel and neighboring pixels, as illustrated in FIG. 6C, reverse tilt in the own pixel occurs in the inner peripheral region which goes along the left side and the lower side. Accordingly, when focusing to a certain n frame, if the following conditions are satisfied, it can be said that the n frame is influenced by reverse tilt domain in the subsequent pixel.

That is, (1) a case in which the dark pixel and the light pixel are adjacent to each other when focusing to the n frame, that is, a pixel in which the application voltage is low, and a pixel in which the application voltage is high are adjacent to each other, thereby increasing the transverse electric field, (2) in the n frame, when the light pixel (high application voltage) is located on the lower left side, the left side, or the lower side corresponding to the upstream side of the tilt azimuth in the liquid crystal molecules with respect to adjacent dark pixels (low application voltage), (3) and when a pixel which is changed to the light pixel in the n frame is in a state in which liquid crystal molecules are unstable in an (n−1) frame which is an immediately previous frame, the reverse tilt occurs in the light pixel in the n frame.

Though the reason has been described in advance, in (2), when a boundary denoting a portion at which the dark pixel and the light pixel are adjacent to each other is moved by one pixel from the previous frame, it is considered that the boundary is further easily influenced by the reverse tilt domain.

For this reason, when the dark pixel and the light pixel are adjacent to each other in an image which is denoted by the video signal Vid-in, and the dark image is located at the upper right side, the right side, or the upper side with respect to the light pixel, the correction voltage is applied to a liquid crystal molecule corresponding to the dark pixel. By doing that, a bad alignment state of liquid crystal molecules hardly occurs, and the reverse tilt domain does not occur in the n frame by shortening a period satisfying the conditions (1) to (3).

Figures 29A, 29B:
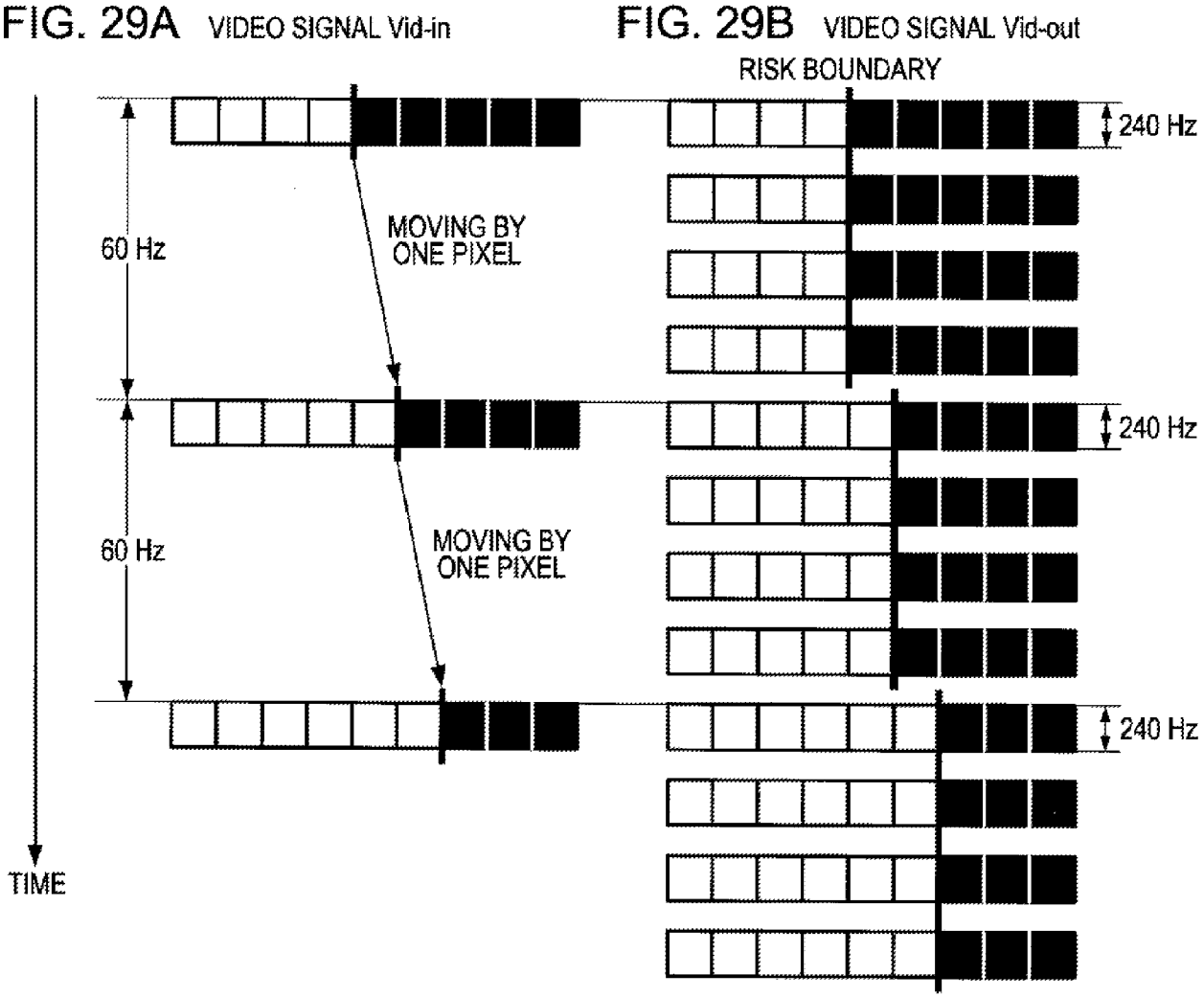
FIGS. 29A and 29B are explanatory diagrams which illustrate a relationship between input-output video signals which are driven at four times normal speed.

Here, a relationship between the video signal Vid-in (FIG. 29A) and video signal Vid-out (FIG. 29B) in normal quad-speed driving will be described. In FIGS. 29A and 29B, pixels of an image of one line are denoted, and each rectangle corresponds to one pixel. Here, pixels which are denoted by being filled in black have the minimum grayscale bk of a black level, and pixels which are denoted by being filled in white have the maximum grayscale wt of a white level. According to the embodiment, a video signal with the minimum grayscale bk is a signal which designates an application voltage to the liquid crystal element 120 of which a difference in potential from the voltage LCcom of the common electrode 108 is 0 V, and has the minimum voltage which is used when expressing the grayscale in the liquid crystal display device 1. On the other hand, a video signal with the maximum grayscale wt is a signal which designates an application voltage to the liquid crystal element 120 of which a difference in potential from the voltage LCcom of the common electrode 108 is 5.0 V, and has the maximum voltage which is used when expressing the grayscale in the liquid crystal display device 1.

In FIG. 29B, as video signals Vid-out corresponding to the video signal Vid-in, video signals Vid-out corresponding to the first, second, third, and fourth field are denoted in order from the top of the figure, respectively.

As illustrated in FIG. 29A, the video signal Vid-in is supplied at a supply speed of 60 Hz, and designates a display of an image which performs a scroll movement in which the image is moved by one pixel from the left to the right in the figure when proceeding to the first frame, the second frame, and the third frame by the video signal Vid-in. In this case, when the video signal Vid-out is output, as illustrated in FIG. 29B, the risk boundary is present at the same position in the whole period of one frame which is configured by the first to fourth fields (that is, over 16.67 milliseconds). When the risk boundary is present for a long period of time at the same position, as described above, the bad alignment state of the liquid crystal molecule easily stabilizes, and the reverse tilt domain easily occurs in the neighboring pixels. Therefore, in a case where the application voltage which is designated in the video signal Vid-in is lower than the Vth1, when the application voltage is corrected to a voltage of Vth1 or more, and is applied to the liquid crystal molecule, the pixel does not become a dark pixel, and as a result, the risk boundary does not present at the same position in the whole period of one frame.

However, if the video signal is corrected, then the voltage which is applied to the liquid crystal element 120 is caused to be changed from the original voltage, there may be a case where transmittance of the liquid crystal element 120 is changed, and it causes defective display.

Figures 30A, 30B:
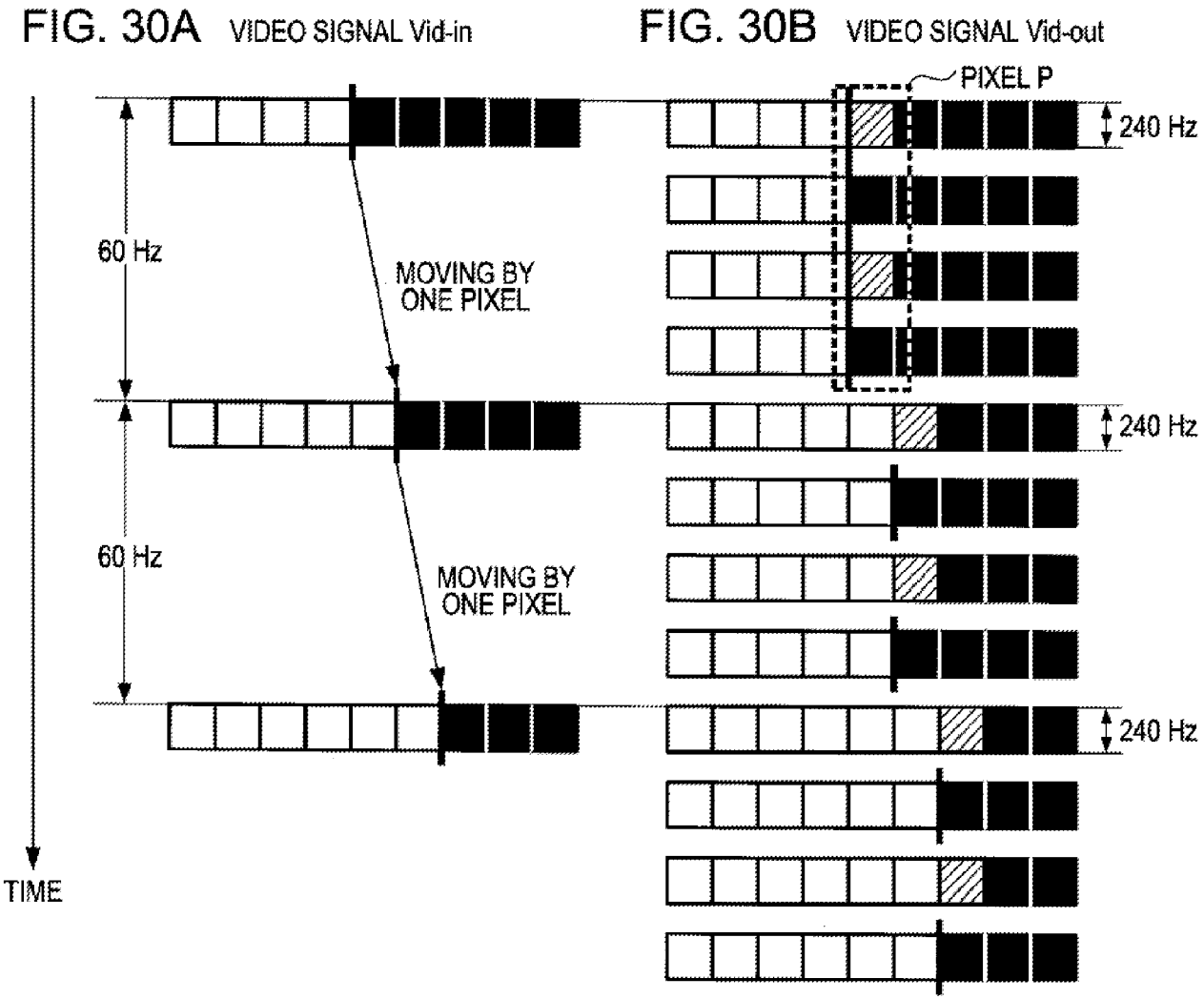
FIGS. 30A and 30B are explanatory diagrams of an example of correction processing in which time continuity at the risk boundary is cut.

Here, a correction process which is illustrated in FIGS. 30A and 30B will be considered. In the first and third fields of one frame, an application voltage of dark pixels which come into contact with the risk boundary (denoted by hatching of lattice in FIG. 30B) is corrected to a voltage corresponding to the intermediate grayscale (here, set to 2.5 V as intermediate voltage of 0 V and 5.0 V). By doing that, the transverse electric field is not generated in the first and third fields which are the risk boundaries, it is possible to cut time continuity of the transverse electric field. A change in time sequence of transmittance of the pixels as the correction target in this case becomes an optical response waveform which is denoted in a solid line in FIG. 31A. The transmittance of the liquid crystal element in the whole period of one frame corresponds to transmittance in which transmittance to which a correction voltage corresponding to correction grayscale, and a voltage corresponding to grayscale in the original image (hereinafter, referred to as "original grayscale") are alternately applied is subject to the time integration over one frame period (hereinafter, referred to as "integral transmittance"). The integral transmittance is denoted by a dashed line in FIG. 31A.

Figures 31A, 31B:
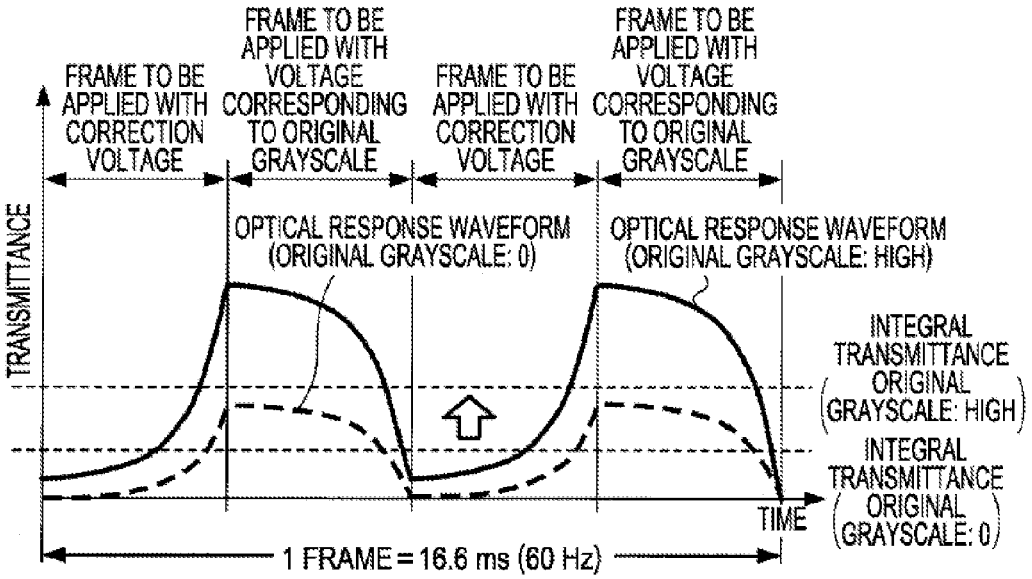
FIGS. 31A and 31B are diagrams which illustrate a measurement result of changes in transmittance between the original grayscale and the correction grayscale.

FIG. 31B is a table which illustrates a measurement result of the integral transmittance when the liquid crystal panel of VA method is driven at 240 Hz, and a frame to which a correction voltage is applied, and a frame to which a voltage corresponding to the original grayscale is applied are alternated. Numerals in the table denote the integral transmittance (%). When an application voltage corresponding to the original grayscale is 0 V, the integral transmittance is slightly changed from 0% to 0.64% due to an application of the correction voltage (approximately 2.51 V corresponding to intermediated grayscale), the change is relatively small (corresponding to case of "original grayscale: 0", in FIG. 31A). On the other hand, when the application voltage corresponding to the original grayscale is 1.569 V, the integral transmittance is greatly changed from 0.18% to 5.865% due to the application of the correction voltage (approximately 2.51 V) (corresponding to case of "original grayscale: high", in FIG. 31A). In this manner, when the integral transmittance is greatly changed, the defective display due to the application of the correction voltage is easily perceived by a user. Accordingly, in a case of performing the correction processing which is illustrated in FIGS. 30A and 30B, in order to suppress an influence by the defective display, it is necessary to limit the pixel as the correction target to a pixel of which the application voltage corresponding to the original grayscale is 1.26 V or less (range denoted in "usable range" in FIG. 31B), and to further reduce the correction voltage approximately to 2.2 V. However, it is difficult to obtain a sufficient effect of reducing the reverse tilt domain in the correction processing, since the pixel as the correction target is limited, and a voltage range which is adopted as the correction voltage is narrow.

Figure 4B:
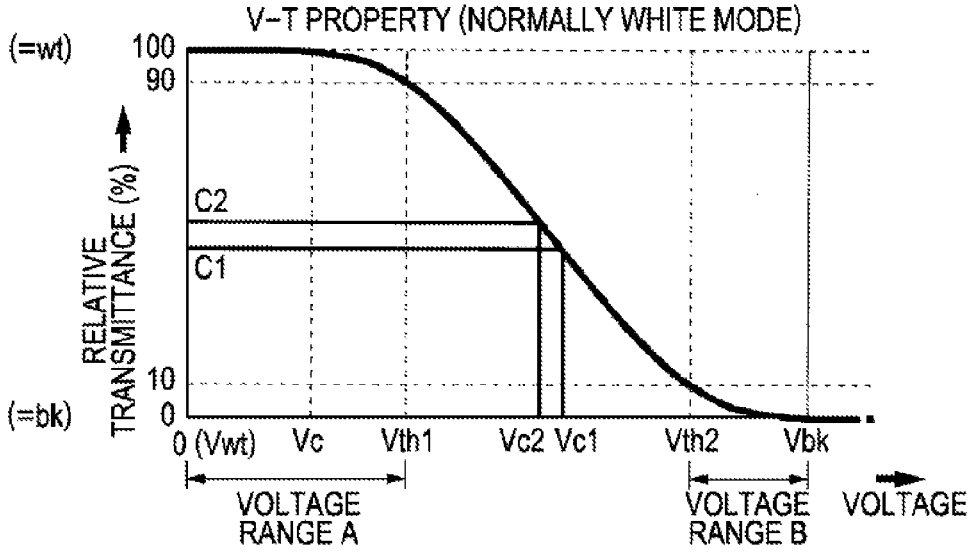

Therefore, according to the embodiment, a correction voltage higher than the application voltage corresponding to the original grayscale is applied in a part of period of one frame (first period), and a correction voltage lower than the application voltage corresponding to the original grayscale is applied in other periods of one frame (second period). Hereinafter, the correction voltage in the first period is set to "Vc1" which is illustrated in FIGS. 4A and 4B, and corresponding correction grayscale is set to "c1". The correction grayscale c1 is a grayscale level which belongs to a grayscale range d. In addition, a correction voltage in the second period is set to "Vbk" which is illustrated in FIGS. 4A and 4B, and corresponding correction grayscale is set to "bk".

According to the embodiment, as illustrated in FIG. 7, when an application voltage corresponding to the original grayscale is 1.6 V or less, the correction voltage Vc1 of 2.5 V is applied in the first period, and the correction voltage Vbk of 0 V is applied in the second period. By performing such correction processing, it is possible to suppress a change in integral transmittance in each frame compared to a case in which correction processing of changing the application voltage in each frame is performed only in one direction as described using FIGS. 30A and 30B. As it can be understood from the table in FIG. 7, as well, according to the embodiment, since the change in the integral transmittance is small, the defective display due to the correction in video signal is not easily perceived by a user even when the integral transmittance in one frame period is set to constant grayscale (constant correction voltage) regardless of the original grayscale.

In addition, when correction processing which is illustrated in FIGS. 30A and 30B is performed, as described above, it is necessary to limit the pixel as the correction target to a pixel of which the application voltage corresponding to the original grayscale is 1.26 V or less. In contrast to this, according to the embodiment, since a change in the integral transmittance is 0.64% or less, even when the application voltage corresponding to the original grayscale is approximately 1.6 V, the usable range of the correction voltage such as the Vc1, and the Vbk becomes wide. In addition, when the correction processing is performed so that a change in the integral transmittance due to the correction of video signal is 1.0% or less, the defective display due to the correction is not easily perceived by a user. Accordingly, an upper limit of the application voltage corresponding to the original grayscale of a pixel as the correction target may be further increased, and the correction voltage Vc1 may be changed to another voltage so that the change in the integral transmittance is in a range of 1.0% or less.

In addition, according to the embodiment, since it is also possible to perform a uniform correction with respect to a display pattern to which a complicated transverse electric field is applied in the original image, it is possible to obtain a stable effect of reducing the reverse tilt domain. Here, when considering a reduction in change in the integral transmittance, it is possible to increase the effect of reducing the reverse tilt domain by setting the correction voltage in the first period to a higher voltage, when the correction voltage of the second period is lower. For this reason, the correction voltage of the second period is set to the Vbk corresponding to the minimum grayscale bk.

A circuit for suppressing the occurrence of the reverse tilt domain in the liquid crystal panel 100 in advance by processing the video signal Vid-in of a current frame based on such a consideration is the image processing circuit 30 in FIG. 1.

Figure 3:
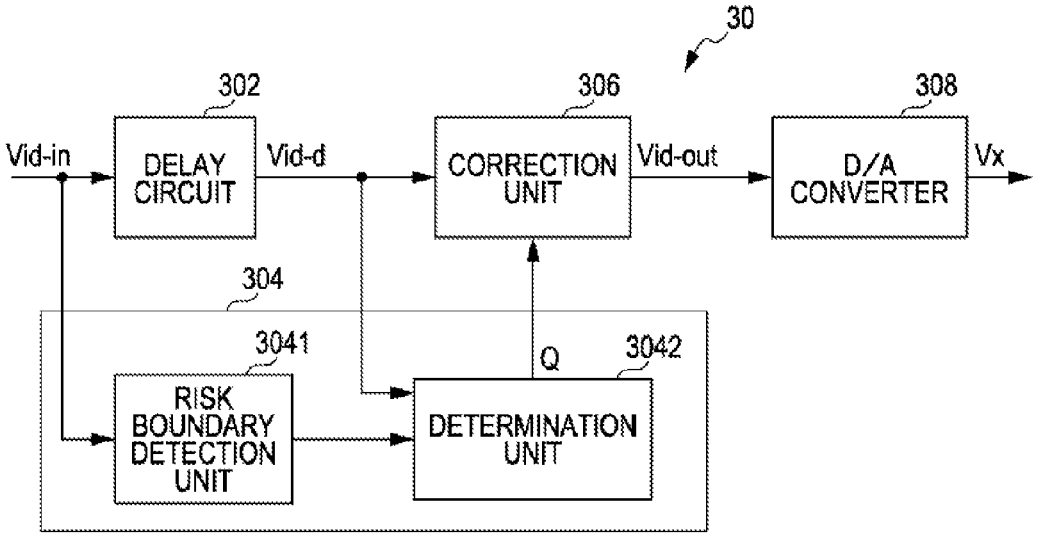
FIG. 3 is a diagram which illustrates a configuration of the video processing circuit.

Subsequently, the image processing circuit 30 will be described in detail with reference to FIG. 3. As illustrated in FIG. 3, the image processing circuit 30 includes a delay circuit 302, a boundary detection unit 304, a correction unit 306, and a D/A converter 308.

The delay circuit 302 is configured by a FIFO (First In First Out) memory, a multistage latch circuit, or the like, accumulates the video signal Vid-in which is supplied from a host device, and outputs as the video signal Vid-d by reading out the video signal Vid-in after a predetermined time has passed. In addition, the accumulation and reading out in the delay circuit 302 are controlled by the scanning control circuit 20.

The boundary detection unit 304 includes a risk boundary detection unit 3041, and a determination unit 3042.

The risk boundary detection unit 3041 analyzes an image which is denoted by the video signal Vid-in, and determines whether or not there is a portion at which a dark pixel in a grayscale range a, and a light pixel in a grayscale range b are adjacent to each other in the vertical direction, or the horizontal direction. In addition, the risk boundary detection unit 3041 detects a portion at which the dark pixel is located on the upper side, and the light pixel is located on the lower side, and a portion at which the dark pixel is located on the right side, and the light pixel is located on the left side as the risk boundary, and outputs position information on the detected risk boundary.

In addition, the boundary here is merely a portion at which the dark pixel in the grayscale range a, and the light pixel in the grayscale range b are adjacent to each other that is, a portion at which a strong transverse electric field is generated. For this reason, a portion at which, for example, a pixel in the grayscale range a, and a pixel in a separate grayscale range d (refer to FIG. 4A) which is not the grayscale range a, or the grayscale range b are adjacent to each other, or a portion at which a pixel in the grayscale range b, and a pixel in the grayscale range d are adjacent to each other is not regarded as a boundary.

The determination unit 3042 determines whether or not a pixel which is denoted by the video signal Vid-d which is output by being delayed is the dark pixel which comes into contact with the risk boundary which is detected by the risk boundary detection unit 3041. In addition, when the determination result is "Yes", the risk boundary detection unit 3041 outputs a flag Q of an output signal as "Q1" in the first and third fields (first period) of one frame, and outputs the flag Q of the output signal as "Q2" in the second and fourth fields (second period) of one frame with respect to the dark pixel. On the other hand, when the determination result is "No", the determination unit 3042 outputs the flag Q of the output signal as "Q3".

In addition, here, "coming into contact with risk boundary" also includes a case in which a risk boundary which is continuous vertically and horizontally at a corner of a pixel is located, in addition to a case in which a pixel comes into contact with the risk boundary along one side of the pixel. In the latter case, the dark pixel becomes a pixel as the correction target even if the dark pixel is not adjacent to a light pixel. In addition, the risk boundary detection unit 3041 is unable to detect a boundary of an image to be displayed in the vertical direction, or the horizontal direction when not accumulating some video signals (at least three or more rows). For this reason, the delay circuit 302 is provided so as to adjust a supply timing of the video signal Vid-in from the host device.

Since a timing of the video signal Vid-in which is supplied from the host device, and a timing of a video signal Vid-d which is supplied from the delay circuit 302 are different from each other, strictly speaking, a horizontal scanning period or the like of both do not match, however, hereinafter, descriptions will be made without being distinguished in particular.

In addition, the accumulation of the video signal Vid-in or the like in the risk boundary detection unit 3041 is controlled by the scanning control circuit 20.

The correction unit 306 corrects the video signal Vid-d of a dark pixel to be a video signal with the correction grayscale c1, and outputs the video signal as the video signal Vid-out when the grayscale level of the video signal Vid-d is the first threshold level (grayscale level corresponding to application voltage of 1.6 V, here) or less, and if the flag Q which is supplied from the determination unit 3042 is "Q1". In addition, the correction unit 306 corrects the video signal Vid-d to be the minimum grayscale bk, and outputs the video signal as the video signal Vid-out when the grayscale level of the video signal Vid-d is the first threshold level or less, and if the flag Q which is supplied from the determination unit 3042 is "Q2". On the other hand, when the flag Q is "Q3", the correction unit 306 outputs the video signal Vid-d as the video signal Vid-out without correcting the video signal.

The D/A converter 308 converts the video signal Vid-out which is digital data into an analog data signal Vx. According to the embodiment, since a surface inversion method is adopted, a polarity of the data signal Vx is switched in each writing of one frame in the liquid crystal panel 100.

Subsequently, a display operation in the liquid crystal display device 1 will be described. In the display operation, the video signal Vid-in is supplied from the host device in an order of the first row, the first column to the first row, the nth column, the second row, the first column to the second row, the nth column, the third row, the first column to the third row, the nth column, . . . , the mth row, the first column to the mth row, the nth column. The video processing circuit 30 performs processing of delay, correction, or the like with respect to the video signal Vid-in, and outputs the video signal as the video signal Vid-out.

Here, the processed video signal Vid-out is converted into a data signal Vx with positive polarity, or negative polarity by the D/A converter 308 as illustrated in FIG. 5B so that the writing polarity is switched in each filed according to whether it is an odd number field, or an even number field when viewed in a horizontal effective scanning period (Ha) during which the video signal Vid-out of the first row, the first column to the first row, the nth column is output. In the first field, the video signal Vid-out is converted to the data signal with positive polarity. The data signal Vx is sampled as data signals X1 to Xn in the data lines 114 of the first to nth column by the data line driving circuit 140.

On the other hand, in the horizontal scanning period during which the video signal Vid-out of the first row, the first column to the first row, the nth column is output, the scanning control circuit 20 controls the scanning line driving circuit 130 so that only a scanning signal Y1 becomes an H level. When the scanning signal Y1 is the H level, the data signal which is sampled in the data line 114 is applied to the pixel electrode 118 through the TFT 116 which is in ON state, since the TFT 116 on the first row is in ON state. In this manner, voltages with positive polarity corresponding to a grayscale level which is designated in the video signal Vid-out are respectively written in the liquid crystal elements of the first row, the first column to the first row, the nth column.

Subsequently, similarly, a video signal Vid-in on the second row, the first column to the second row, the nth column is processed by the video processing circuit 30, is output as a video signal Vid-out, is converted to a data signal with the positive polarity by the D/A converter 308, and then is sampled in the data lines 114 on the first to nth columns by the data line driving circuit 140.

In the horizontal scanning period in which the video signals Vid-out on the second row, the first column to the second row, the nth column, since only a scanning signal Y2 becomes the H level by the scanning line driving circuit 130, a data signal which is sampled in the data line 114 is applied to the pixel electrode 118 through the TFT 116 on the second row which is in ON state. In this manner, voltages with the positive polarity corresponding to a grayscale level which is designated in the video signal Vid-out, respectively, are written in the liquid crystal elements on the second row, the first column to the second row, the nth column.

Hereinbelow, a similar write operation is performed with respect to the third, fourth, . . . , mth row, and in this manner, a voltage corresponding the a grayscale level which is designated in the video signal Vid-out is written in each liquid crystal element, and a transmission image which is defined in the video signal Vid-in is created.

In the subsequent filed, the same write operation is performed excepting that the video signal Vid-out is converted to a data signal with negative polarity due to polarity inversion of a data signal.

FIG. 5B is a diagram of a voltage waveform which illustrates an example of the data signal Vx in the first and second fields when the video signals Vid-out on the first row, the first column to the first row, the nth column are output from the video processing circuit 30 over the horizontal scanning period (H). According to the embodiment, since the mode is set to the normally black mode, when the data signal Vx has the positive polarity, the data signal Vx becomes a high voltage (denoted by arrow (↑) in figure) by an amount corresponding to the grayscale level which is processed by the video processing circuit 30 with respect to the reference voltage Vcnt, and when the data signal Vx has the negative polarity, the data signal Vx becomes a low voltage (denoted by arrow (↓) in figure) by an amount corresponding to the grayscale level with respect to the reference voltage Vcnt.

Specifically, when a voltage of the data signal Vx has the positive polarity, the voltage becomes a biased voltage by an amount corresponding to a grayscale from the reference voltage Vcnt in a range from a voltage Vw (+) corresponding to white to a voltage Vb (+) corresponding to black, and in a range from a voltage Vw (−) corresponding to white to a voltage Vb (−) corresponding to black, when having the negative polarity, on the other hand, respectively.

The voltages Vw (+) and Vw (−) have a symmetric relationship therebetween having the voltage Vcnt as the center. Voltages Vb (+) and Vb (−) also have the symmetric relationship therebetween having the voltage Vcnt as the center.

In addition, FIG. 5B illustrates a voltage waveform of the data signal Vx, and is different from a voltage which is applied to the liquid crystal element 120 (difference in potential between pixel electrode 118 and common electrode 108). In addition, vertical scales of a voltage of a data signal in FIG. 5B are enlarged compared to a voltage waveform of a scanning signal or the like in FIG. 5A.

A specific example of correction processing by the video processing circuit 30 will be described.

Figures 8A, 8B:
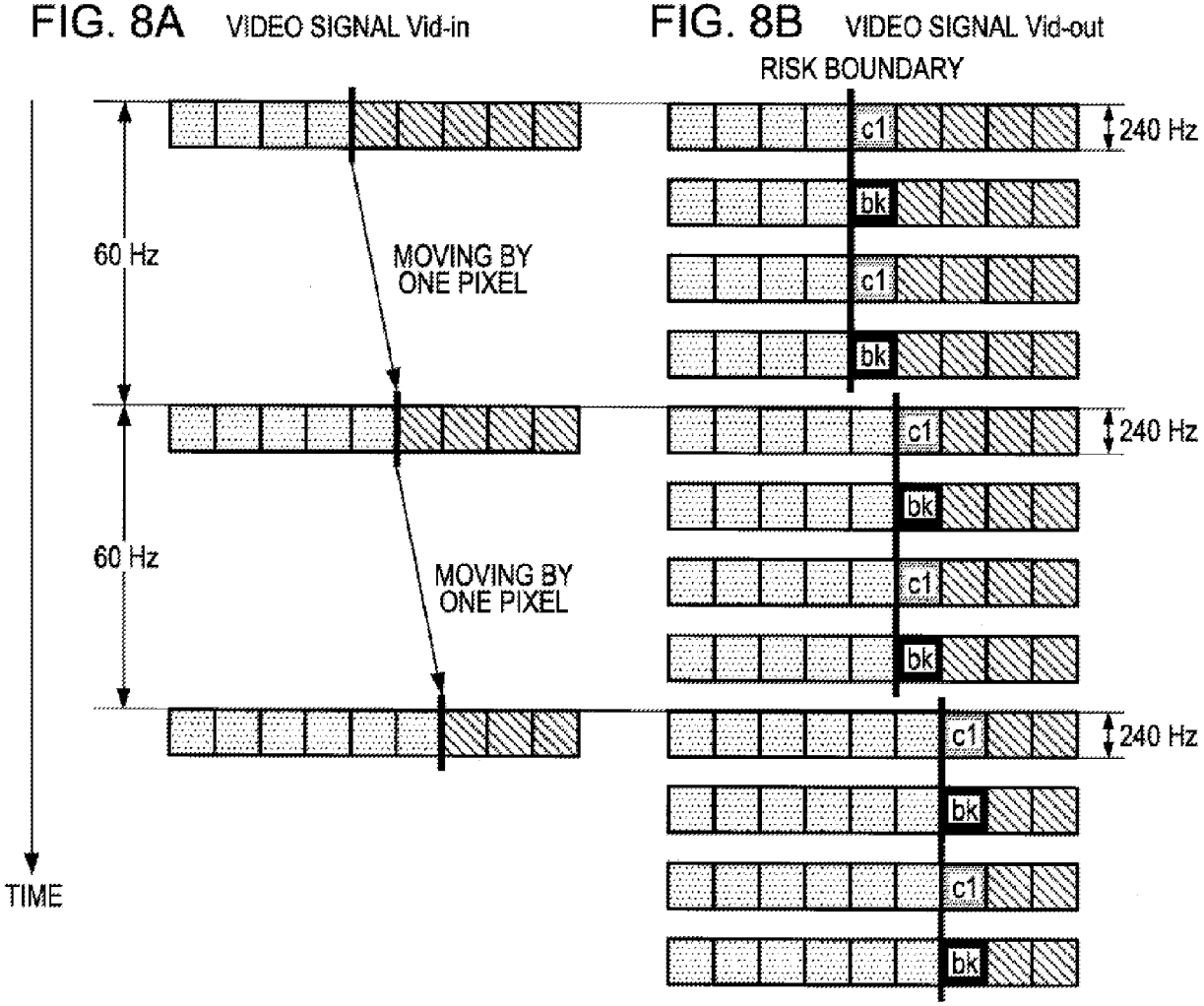
FIGS. 8A and 8B are explanatory diagrams which schematically show correction processing of the video processing circuit.

FIGS. 8A and 8B are diagrams which schematically describe the correction processing of the correction unit 306 in the video processing circuit 30 according to the embodiment. According to the embodiment, when the video signal Vid-in which is illustrated in FIG. 8A is supplied, it is corrected to be the video signal Vid-out which is illustrated in FIG. 8B. As illustrated in FIG. 8B, in the first and third fields in one frame period, dark pixels which come into contact with the risk boundary are corrected to be video signals of the correction grayscale c1, and in the second and fourth fields, dark pixels which come into contact with the risk boundary are corrected to be video signals of the minimum grayscale bk. In this case, a period in which the risk boundary is present at the same position becomes short compared to a case in which the correction of the correction unit 306 is performed, and the change in the integral transmission is suppressed as described above.

In addition, in explanatory diagrams in FIGS. 8A and 8B, or the like which schematically describe the correction processing, pixels in which the inside of the rectangles are expressed by lines slanted rightward correspond to the dark pixels, however, are pixels of which the grayscale level is higher than that of the minimum grayscale bk. In addition, pixels in which the inside of the rectangles are expressed by dots, and characters are written inside the rectangles correspond to the light pixels, however, are pixels of which the grayscale level is lower than that of the maximum grayscale wt. In addition, a description of the "risk boundary" which is illustrated in FIG. 8B in the explanatory diagrams in FIGS. 8A and 8B, for example, which schematically describe the correction processing is a description for making a position of the risk boundary which is detected by a video signal before correction be easily understood, and the risk boundary is not continuously present at the position at least for one frame period in the video signal after correction.

Here, as illustrated in FIG. 9A, when an image which is denoted by the video signal Vid-in is an image in which a region formed by dark pixels (illustrated by black rectangles) is displayed having light pixels (illustrated by white rectangles) as a background, a boundary which is detected by the risk boundary detection unit 3041 becomes a boundary which is illustrated in FIG. 9B. In this case, the correction unit 306 sets the dark pixels which come into contact with the detected risk boundary which are denoted by hatching of lattice in FIG. 10A as the correction target. In addition, in the following descriptions, as well, pixels which are denoted by the hatching of lattice are pixels as the correction target.

In addition, a dark pixel in which a risk boundary which is continuous vertically and horizontally is located at a certain corner of the dark pixel is also treated as the pixel which "comes into contact with risk boundary", as described above. This is for dealing with a case in which an image is moved by one pixel in the oblique direction. In contrast to this, a dark pixel in which a broken risk boundary is located at a certain corner of the dark pixel only in vertical, or in horizontal is not considered as a dark pixel which comes into contact with the risk boundary, since the risk boundary which is continuous vertically and horizontally is not present.

In the above described video processing circuit 30 according to the first embodiment, the grayscale level of the dark pixel is corrected to be high in a part of one frame period, and the grayscale level of the dark pixel is corrected to be low in other periods of the one frame period. By performing such correction processing, the risk boundary is not continuously present at the same position in one frame period, and the change in integral transmittance can be suppressed compared to the correction processing which is described in FIGS. 30A and 30B, regardless of the original grayscale, accordingly, it is possible to suppress the occurrence of display defect which is caused by the change in integral transmittance of the liquid crystal element in each frame.

Modification Example of First Embodiment

According to the above described second embodiment, a case in which the tilt azimuth θb is 45° in the VA method has been exemplified, however, as disclosed in JPA-2011-107174, it is possible to reduce the pixels as the correction target compared to the first embodiment even when the tilt azimuth θb is a different angle. An example in which the tilt azimuth θb is 225° will be described.

Figure 11A:
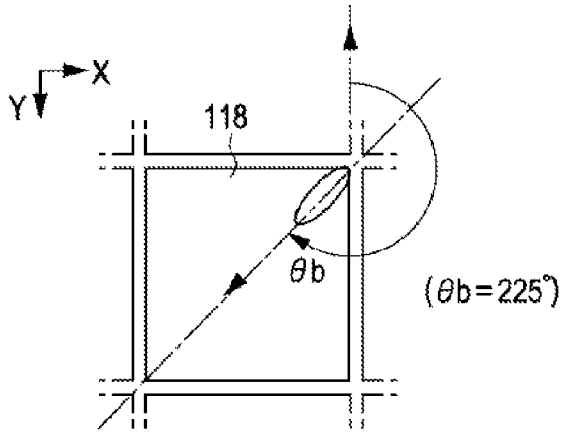
FIGS. 11A and 11B are diagrams when another tilt azimuth angle is adopted in the liquid crystal panel.
Figure 11B:
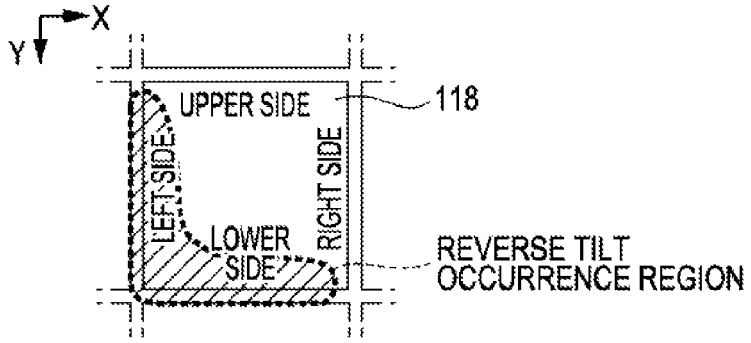

First, as illustrated in FIG. 11A, when only the own pixel is changed to a light pixel in a state in which liquid crystal molecules are unstable in the own pixel and the peripheral pixel, the reverse tilt in the own pixel occurs in the inner peripheral region which goes along the left side and the lower side, as illustrated in FIG. 11B. In addition, in the example, it is equivalent to a case in which the example in which the tilt azimuth θb is 45° illustrated in FIG. 6C is rotated by 180°.

When the tilt azimuth θb is 225°, the condition (2) among the conditions (1) to (3) in which the reverse tilt domain occurs when the tilt azimuth θb is 45° is corrected as follows. That is, the condition (2) is corrected as follows:

(2) in the n frame, when the light pixel (high application voltage) is located on the upper right side, the right side, or the upper side corresponding to the upstream side of the tilt azimuth in the liquid crystal molecule with respect to adjacent dark pixels (low application voltage). In addition, the conditions (1) and (3) are not changed.

Accordingly, if the tilt azimuth θb is 225°, when the dark pixel and the light pixel are adjacent to each other in the n frame, and the dark pixel is located on the lower left side, the left side, or the lower side opposite to the light pixel, it is preferable to take a measure so that the liquid crystal molecule does not become unstable with respect to a liquid crystal element corresponding to the light pixel.

For this purpose, the correction unit 306 in the video processing circuit 30 may correct the video signal based on a risk boundary between a portion at which the dark pixel is located on the lower side, and the light pixel is located on the upper side, and a portion at which the dark pixel is located on the left side, and the light pixel is located on the right side.

Accordingly, when the tilt azimuth θb is 225°, in the image which is illustrated in FIG. 9A, pixels as the correction target are determined as illustrated in FIG. 10C.

Figure 12A:
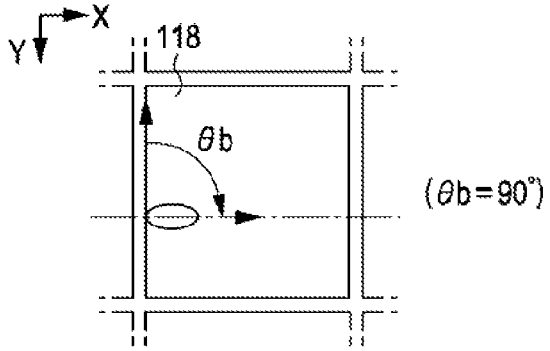
FIGS. 12A and 12B are diagrams when another tilt azimuth angle is adopted in the liquid crystal panel.
Figure 12B:
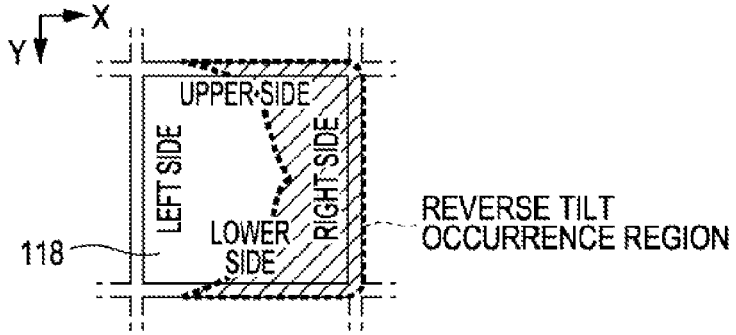

Subsequently, as illustrated in FIG. 12A, an example in which the tilt azimuth θb is 90° will be described. In the example, when only the own pixel is changed to a light pixel in a state in which liquid crystal molecules are unstable in the own pixel and the peripheral pixel, as illustrated in FIG. 12B, the reverse tilt in the own pixel intensively occurs in a region which goes along the right side. For this reason, it is also possible to consider that the reverse tilt domain in the own pixel also occurs in the vicinity of the right side on the upper side, and the vicinity of the right side on the lower side.

For this reason, when the tilt azimuth θb is 90°, the condition (2) among the conditions (1) to (3) in which the reverse tilt domain occurs when the tilt azimuth θb is 45° is corrected as follows. That is, the condition (2) is corrected as follows. That is, (2) in the n frame, when the light pixel (high application voltage) is located not only on the left side corresponding the upstream side of the tilt azimuth in the liquid crystal molecule, but also on the upper side, or the lower side which is influenced by a region in which the reverse tilt domain occurs on the left side thereof with respect to adjacent dark pixels (low application voltage). In addition, the conditions (1) and (3) are not changed.

Accordingly, if the tilt azimuth θb is 90°, it is a case in which the dark pixel and the light pixel are adjacent to each other in the n frame, and it is preferable to take a measure so that the liquid crystal molecules are not in an unstable state with respect to the liquid crystal element corresponding to the dark pixel when the dark pixel is located on the right side, the lower side, or the upper side with respect to the light pixel.

For this purpose, the correction unit 306 in the video processing circuit 30 may correct the video signal based on a risk boundary between a portion at which the dark pixel is located on the right side, and the light pixel is located on the left side, and a portion at which the dark pixel is located on the lower side, and the light pixel is located on the upper side.

When the tilt azimuth θb is 90°, pixels as the correction target in the image illustrated in FIG. 9A are determined as illustrated in FIG. 10B.

Second Embodiment

Subsequently, a second embodiment of the present invention will be described. In the second embodiment, descriptions will be made on the premise that the mode is the normally black mode, as well. This will be similarly applied to each embodiment hereinafter, unless otherwise noted. In addition, in the descriptions below, the same configuration as that in the first embodiment will be denoted by the same reference numerals, and detailed descriptions thereof will be appropriately omitted. In the above described first embodiment, the video processing circuit 30 corrects the video signal only for the dark pixel which comes into contact with the risk boundary, however, according to the embodiment, the correction is made so that video signals of two or more dark pixels which are continuous in the direction opposite to the risk boundary from the dark pixel which comes into contact with the risk boundary are corrected.

Changed determination contents in a determination unit 3042, and changed pixels as correction targets in a correction unit 306 are differences of a video processing circuit 30 according to the embodiment from those in the configuration of the first embodiment.

A determination unit 3042 determines whether or not a pixel which is denoted by a video signal Vid-d is a dark pixel which is detected by a risk boundary detection unit 3041, and comes into contact with the risk boundary. In addition, when the determination result is "Yes", the determination unit 3042 outputs a flag Q of an output signal as "Q1" in the first and third fields of one frame period regarding r dark pixels (r=2 in the embodiment) which are continuous in the direction opposite to the risk boundary from the dark pixel, and outputs a flag Q of the output signal as "Q2" in the second and fourth fields of the one frame period. The determination unit 3042 outputs the flag Q of the output signal as "Q3" in cases other than those.

When the grayscale level of the video signal Vid-d is the first threshold level or less, and if the flag Q which is supplied from the determination unit 3042 is "Q1", the correction unit 306 corrects the video signal Vid-d of the dark pixel to be the video signal of correction grayscale c1, and outputs the video signal as the video signal Vid-out. When the grayscale level of the video signal Vid-d is the first threshold level or less, and if the flag Q which is supplied from the determination unit 3042 is "Q2", the correction unit 306 corrects the video signal Vid-d of the dark pixel to be the video signal with the minimum grayscale bk, and outputs the video signal as the video signal Vid-out. On the other hand, when the flag Q is "Q3", the correction unit 306 outputs the video signal Vid-d as the video signal Vid-out as is, without correcting the video signal.

A specific example of correction processing by the video processing circuit 30 will be described.

Figures 13A, 13B:
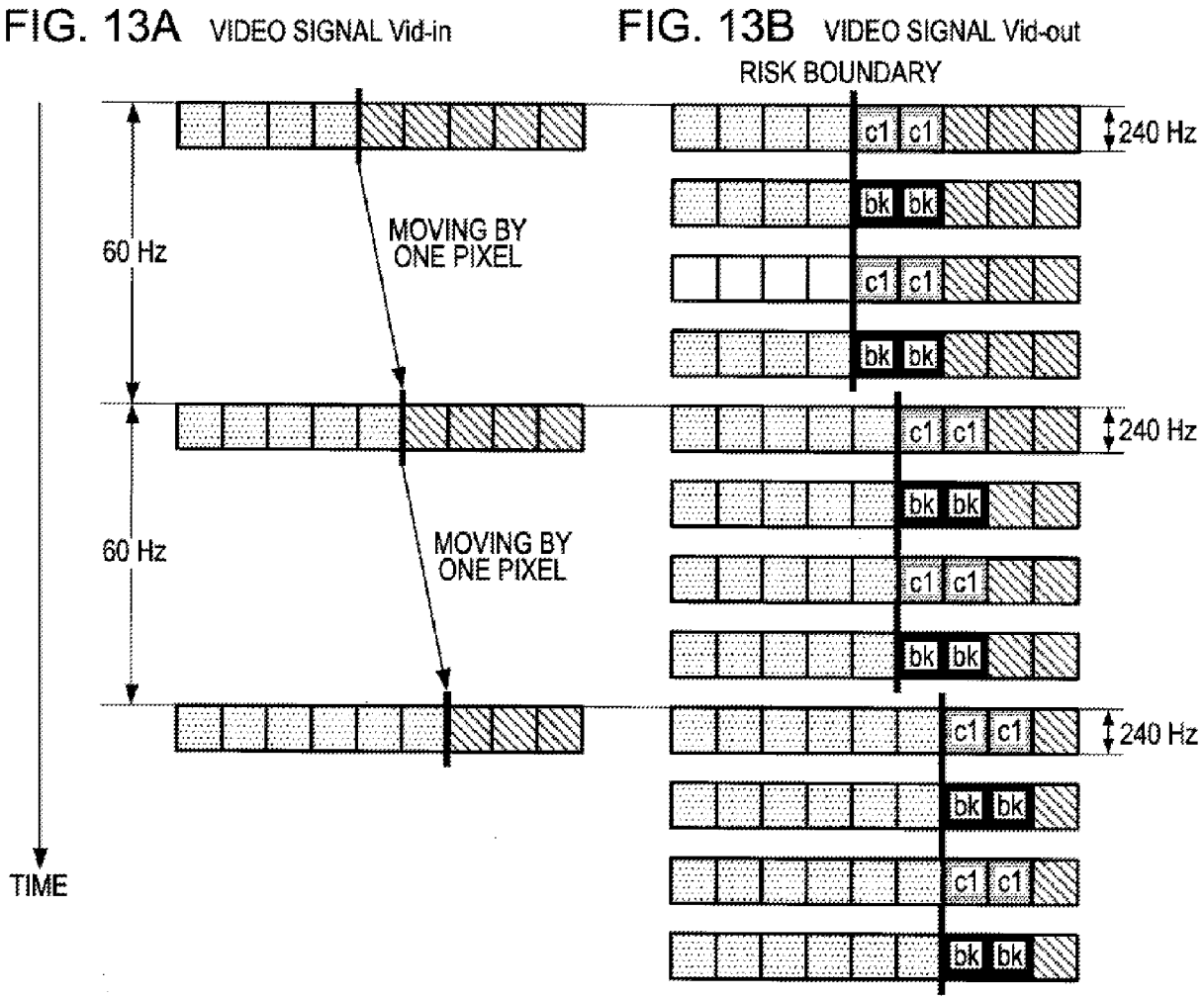
FIGS. 13A and 13B are diagrams which schematically describe correction processing in a video processing circuit according to a second embodiment of the invention.

According to the embodiment, when the video signal Vid-in which is illustrated in FIG. 13A is supplied, the video signal is corrected to be the video signal Vid-out which is illustrated in FIG. 13B. As illustrated in FIG. 13B, according to the embodiment, two dark pixels which are continuous in the direction opposite to the risk boundary from the dark pixel which comes into contact with the risk boundary are corrected to be the video signal of correction grayscale c1 in the first and third fields, and two dark pixels which are continuous in the direction opposite to the risk boundary from the dark pixel which comes into contact with the risk boundary are corrected to be the video signal with the minimum grayscale bk in the second and fourth fields.

When the image which is denoted by the video signal Vid-in is the same as that which is illustrated in FIG. 9A, and the risk boundary is detected as illustrated in FIG. 9B, the correction unit 306 sets the dark pixels which are denoted by hatching in FIG. 14A to pixels as the correction target. In addition, when θb is 90° according to the same way of thinking as that in the first embodiment, pixels as the correction target of the image which is illustrated in FIG. 9A are the same as those which are illustrated in FIG. 14B. When θb is 225°, pixels as the correction target of the image which is illustrated in FIG. 9A are the same as those which are illustrated in FIG. 14C.

According to the embodiment, it is possible to make a change in the plurality of pixels which come into contact with the risk boundary less noticeable. In addition, according to the configuration of the embodiment, it is possible to obtain the same effect as that in the first embodiment in addition to those which are described above.

Third Embodiment

Subsequently, a third embodiment of the present invention will be described.

According to the embodiment, a video processing circuit 30 corrects a video signal of a light pixel which comes into contact with a risk boundary instead of a dark pixel which come into contact with the risk boundary. According to the embodiment, a correction unit 306 does not correct the video signal of the dark pixel. In this case, in a part of one frame period (first period), a correction voltage which is lower than an application voltage corresponding to the original grayscale is applied. Hereinafter, a correction voltage in the first period is set to "Vc2" which is illustrated in FIGS. 4A and 4B, and corresponding correction grayscale is set to "c2". The correction grayscale c2 is a grayscale level which belongs to a grayscale range d. In addition, a correction voltage in the second period is set to "Vwt" which is illustrated in FIGS. 4A and 4B, and corresponding correction grayscale is set to "wt".

Even in a case in which a light pixel is set to a pixel as the correction target, when the video processing circuit 30 performs a correction of lowering an application voltage which is designated by a video signal, and a correction of increasing the application voltage in one frame period, a change in an integral transmittance in each frame is suppressed, and a display defect is not easily perceived. Further, when considering reducing a change in the integral transmittance, it is possible to increase an effect of reducing the reverse tilt domain by setting a correction voltage which is applied in the first period to a lower voltage, when the correction voltage which is applied in the second period is higher. Due to this, the correction voltage in the second period is set to a voltage Vwt corresponding to the maximum grayscale wt.

In addition, according to the embodiment, it is also preferable to determine the correction voltage so that the change in the integral transmittance due to the correction in the video signal becomes, for example, 1.0% or less.

In descriptions below, the same configuration as that in the first embodiment are denoted by the same reference numerals, and descriptions thereof will be suitably omitted.

Regarding a configuration of the video processing circuit 30 according to the embodiment, contents thereof which are different from those in the above described first embodiment will be described.

The determination unit 3042 determines whether or not pixels which are denoted in the video signal Vid-d, and are output by being delayed are light pixels which come into contact with the risk boundary, and are detected in the risk boundary detection unit 3041. In addition, the determination unit 3042 outputs a flag Q of an output signal as "Q1" in the first and third fields of one frame when the determination result is "Yes". On the other hand, the determination unit 3042 outputs the flag Q of the output signal as "Q2" in the second and fourth fields of the one frame when the determination result is "Yes". The determination unit 3042 outputs the flag Q of the output signal as "Q3" in cases other than those.

When the grayscale level of the video signal Vid-d is the second threshold level (here, for example, grayscale level corresponding to application voltage of 3.4 V) or more, and if the flag Q which is supplied from the determination unit 3042 is "Q1", the correction unit 306 corrects the video signal Vid-d of the light pixel to be the video signal with the correction grayscale c2, and outputs the video signal as the video signal Vid-out. When the grayscale level of the video signal Vid-d is the second threshold level or more, and if the flag Q which is supplied from the determination unit 3042 is "Q2", the correction unit 306 corrects the video signal Vid-d of the light pixel to be the maximum grayscale wt, and outputs the video signal as the video signal Vid-out. On the other hand, when the flag Q is "Q3", the correction unit 306 outputs the video signal Vid-d as the video signal Vid-out as is, without correcting the video signal.

A specific example of correction processing by the video processing circuit 30 will be described.

Figures 15A, 15B:
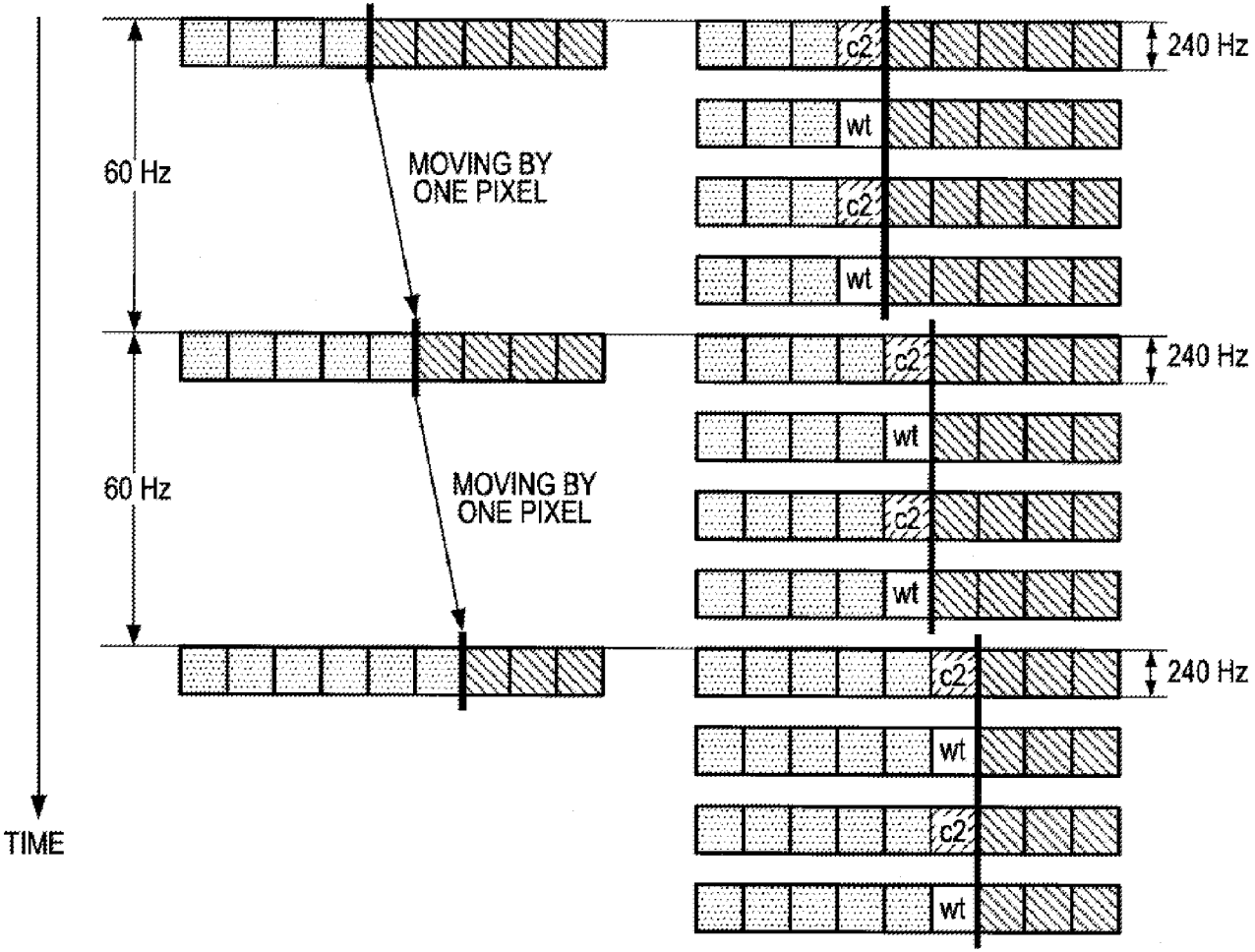
FIGS. 15A and 15B are diagrams which schematically describe correction processing in a video processing circuit according to a third embodiment of the invention.

According to the embodiment, when the video signal Vid-in which defines an image with contents illustrated in FIG. 15A is supplied, the video signal is corrected to be the video signal Vid-out which is illustrated in FIG. 15B. As illustrated in FIG. 15B, in the first and third fields of one frame, light pixels which come into contact with the risk boundary are corrected to be the video signal with the correction grayscale c2. In addition, in the second and fourth fields of the one frame, light pixels which come into contact with the risk boundary are corrected to be the video signal of maximum grayscale wt.

Here, the image which is denoted by the video signal Vid-in is the same as that illustrated in FIG. 9A, the risk boundary as illustrated in FIG. 9B is detected, and the correction unit 306 sets the light pixels which are denoted by hatching of slanted lines in FIG. 16A to pixels as the correction target.

In addition, when θb is 90° according to the same way of thinking as that in the first embodiment, pixels as the correction target of the image which is illustrated in FIG. 9A are the same as those which are illustrated in FIG. 16B. When θb is 225°, pixels as the correction target of the image which is illustrated in FIG. 9A are the same as those which are illustrated in FIG. 16C.

In the above described third embodiment, the video processing circuit 30 sets the light pixels as the correction target, and performs a correction so that the grayscale level of the light pixel is corrected to be low in a part of one frame period, and the grayscale level of the light pixel is corrected to be high in other periods of the one frame period. According to the video processing circuit 30, since the risk boundary is prevented from being continuously present at the same position in one frame period, and the change in the integral transmittance is limited regardless of the original grayscale, it is possible to suppress the occurrence of a defective display which is caused by the change in transmittance of the liquid crystal element.

Fourth Embodiment

Subsequently, a fourth embodiment of the present invention will be described. According to the above described third embodiment, the video processing circuit 30 corrects the video signals of only the light pixels which come into contact with the risk boundary, however, video signals of two or more light pixels which are continuous in the direction opposite to the risk boundary from the light pixel which comes into contact with the risk boundary are corrected in the fourth embodiment.

In this manner, changed determination contents in a determination unit 3042, and changed pixels as correction targets in a correction unit 306 are differences of a video processing circuit 30 according to the embodiment from those in the configuration of the third embodiment.

The determination unit 3042 determines whether or not pixels which are denoted in the video signal Vid-d are light pixels which come into contact with the risk boundary, and are detected in the risk boundary detection unit 3041. In addition, the determination unit 3042 outputs a flag Q of an output signal as "Q1" in the first and third fields of one frame with respect to s light pixels (s=2 in the embodiment) which are continuous in the direction opposite to the risk boundary from the light pixels when the determination result is "Yes", and outputs the flag Q of the output signal as "Q2" in the second and fourth fields of the one frame. The determination unit 3042 outputs the flag Q of the output signal as "Q3" in cases other than those.

When the grayscale level of the video signal Vid-d is the second threshold level or more, and if the flag Q which is supplied from the determination unit 3042 is "Q1", the correction unit 306 corrects the video signal Vid-d of the light pixel to be the video signal with the correction grayscale c2, and outputs the video signal as the video signal Vid-out. When the grayscale level of the video signal Vid-d is the second threshold level or more, and if the flag Q which is supplied from the determination unit 3042 is "Q2", the correction unit 306 corrects the video signal Vid-d of the light pixel to be the video signal with the maximum grayscale wt, and outputs the video signal as the video signal Vid-out. When the flag Q is "Q3", the correction unit 306 outputs the video signal Vid-d as the video signal Vid-out as is, without correcting the video signal.

A specific example of correction processing by the video processing circuit 30 will be described.

According to the embodiment, when the video signal Vid-in which is illustrated in FIG. 17A is supplied, the video signal is corrected to be the video signal Vid-out which is illustrated in FIG. 17B. According to the embodiment, as illustrated in FIG. 17B, two light pixels which are continuous in the direction opposite to the risk boundary from the light pixel which comes into contact with the risk boundary are corrected to be the video signal of correction grayscale c2 in the first and third fields, and two light pixels which are continuous in the direction opposite to the risk boundary from the light pixel which comes into contact with the risk boundary are corrected to be the video signal with the maximum grayscale wt in the second and fourth fields.

Figure 18A:
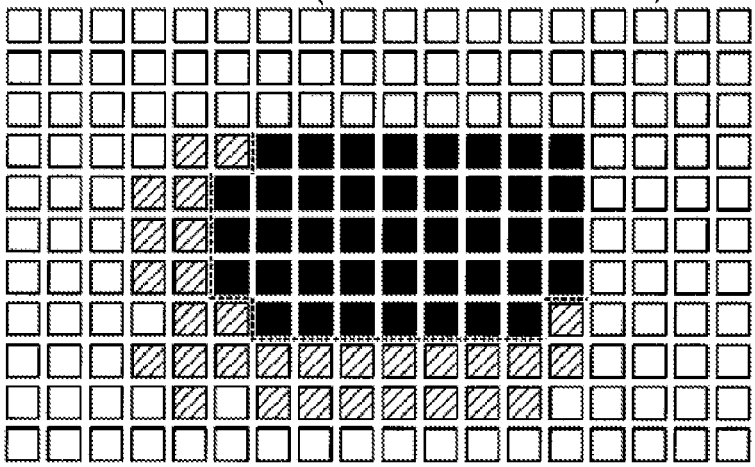
FIGS. 18A to 18C are diagrams which illustrate the correction processing in the video processing circuit.

Here, the image which is denoted by the video signal Vid-in is the same as that illustrated in FIG. 9A, and when the risk boundary is detected as illustrated in FIG. 9B, the correction unit 306 sets the light pixels which are denoted by hatching of slanted lines in FIG. 18A to pixels as the correction target.

Figure 18B:
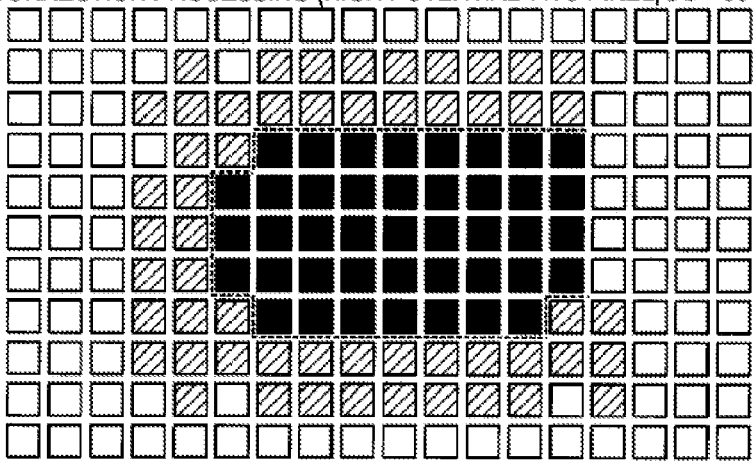
Figure 18C:
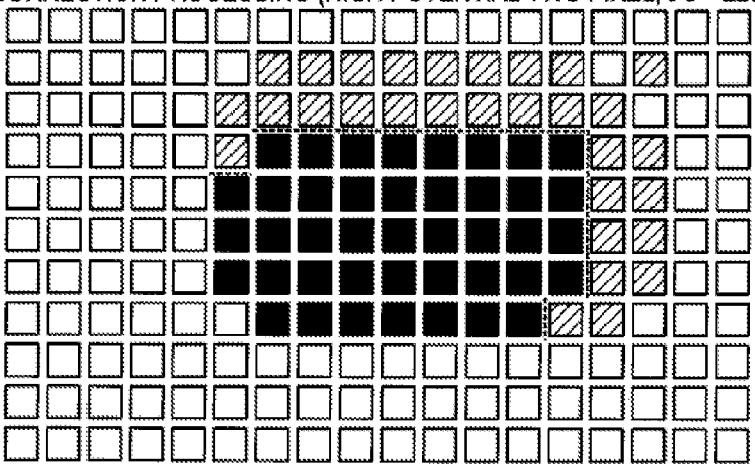

In addition, when θb is 90° according to the same way of thinking as that in the above described first embodiment, pixels as the correction target of the image which is illustrated in FIG. 9A are the same as those which are illustrated in FIG. 18B. When θb is 225°, pixels as the correction target of the image which is illustrated in FIG. 9B are the same as those which are illustrated in FIG. 18C.

According to the embodiment, it is possible to make the change in the application voltage due to the correction of the video signal of a plurality of pixels which come into contact with the risk boundary not noticeable. In addition, according to the configuration of the embodiment, it is possible to obtain the same effect as that in the third embodiment, in addition to that which is described above.

Fifth Embodiment

Subsequently, a fifth embodiment of the present invention will be described.

In the following descriptions, the same configurations as those in the first embodiment are given the same reference numerals, and descriptions thereof will be suitably omitted. According to the embodiment, both the correction of the dark pixel which is described in the first embodiment and the correction of the light pixel which is described in the third embodiment are performed. According to the embodiment, a relationship of c2>c1 is satisfied, however, it may be c2=c1, or c2<c1.

Changed determination contents in a determination unit 3042, and changed pixels as correction targets in a correction unit 306 are differences of a video processing circuit 30 according to the embodiment from the video processing circuit 30 in the third embodiment.

The determination unit 3042 performs both determinations which are described in the above described first and third embodiments. That is, the determination unit 3042 outputs a flag Q of an output signal as "Q1" in the first and third fields in one frame with respect to dark pixels which come into contact with the risk boundary which is detected in the risk boundary detection unit 3041, and outputs the flag Q of the output signal as "Q2" in the second and fourth fields in the one frame. In addition, the determination unit 3042 outputs the flag Q of the output signal as "Q1" in the first and third fields in one frame with respect to light pixels which come into contact with the risk boundary which is detected in the risk boundary detection unit 3041, and outputs the flag Q of the output signal as "Q2" in the second and fourth fields in the one frame. The determination unit 3042 outputs the flag Q of the output signal as "Q3" in cases other than those.

When the video signal of the light pixel is supplied, and the grayscale level becomes the first threshold level or less, and if the flag Q which is supplied from the determination unit 3042 is "Q1", the correction unit 306 corrects the video signal to be the video signal with the correction grayscale c1, and if the flag Q is "Q2", the video signal is corrected to be the video signal with the minimum grayscale bk. When the video signal of the light pixel is supplied, and the grayscale level becomes the second threshold level or more, and if the flag Q which is supplied from the determination unit 3042 is "Q1", the correction unit 306 corrects the video signal to be the video signal with the maximum grayscale wt, and if the flag Q is "Q2", the video signal is corrected to be the video signal with the correction grayscale c2. On the other hand, when the flag Q is "Q3", the video signal Vid-d is output as the video signal Vid-out as is without correcting the video signal.

In addition, according to the embodiment, the light pixel is corrected to be the maximum grayscale wt in the first and third fields, is corrected to be the correction grayscale c2 in the second and fourth fields, and becomes opposite to the correction processing which is described in the third embodiment. This is for preventing the transverse electric field from becoming temporarily strong when the light pixel with the grayscale wt, and the light pixel with the grayscale bk are adjacent to each other. However, it is not a problem even when the dark pixel with the grayscale wt, and the dark pixel with the grayscale bk are adjacent to each other as long as the risk boundaries are not present at the same position in the whole one frame.

A specific example of the correction processing by the video processing circuit 30 will be described.

Figures 19A, 19B:
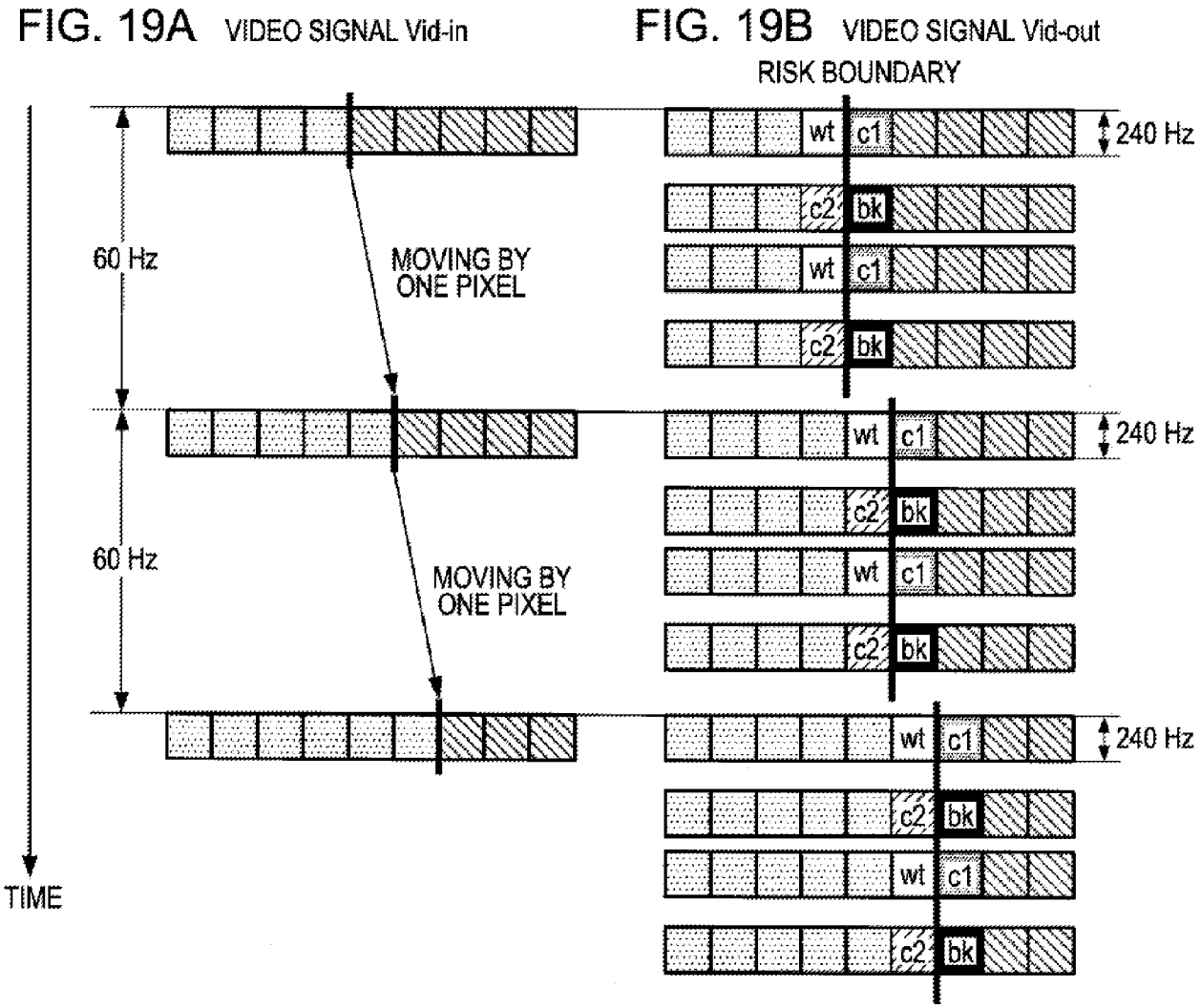
FIGS. 19A and 19B are diagrams which schematically describe correction processing in a video processing circuit according to a fifth embodiment in the present invention.

According to the embodiment, when a video signal Vid-in which defines the image which is illustrated in FIG. 19A is supplied, the video signal is corrected to be the video signal Vid-out which is illustrated in FIG. 19B.

Figure 20A:
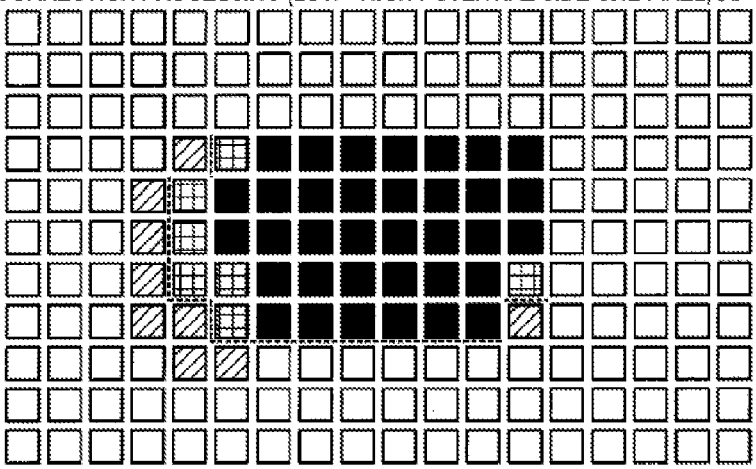
FIGS. 20A to 20*c* are diagrams which illustrate the correction processing in the video processing circuit.

Here, the image which is defined by the video signal Vid-in is the same as that which is illustrated in FIG. 9A, and when the risk boundary is detected as illustrated in FIG. 9B, the correction unit 306 sets the dark pixel and the light pixel which are denoted by hatching of lattice in FIG. 20A to the pixels as the correction targets.

Figure 20B:
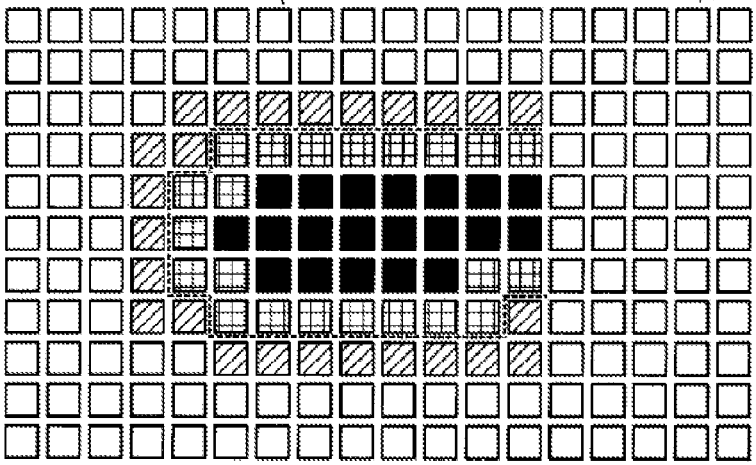
Figure 20C:
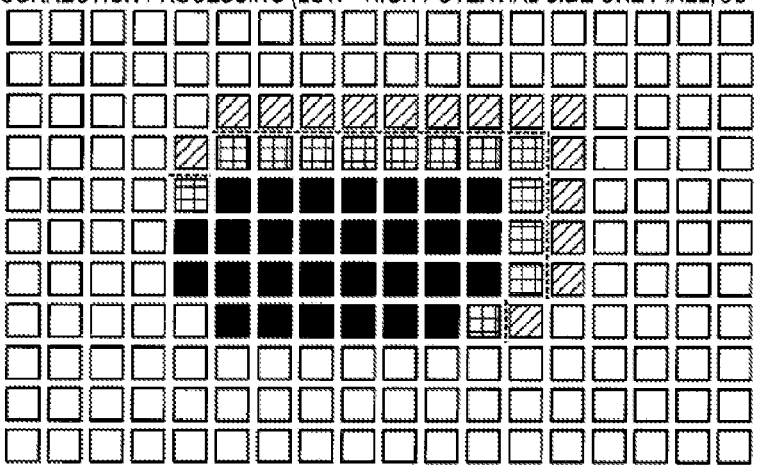

In addition, when θb is 90° according to the same way of thinking as that in the above described first embodiment, pixels as the correction target of the image which is illustrated in FIG. 9A are the same as those which are illustrated in FIG. 20B. When θb is 225°, pixels as the correction target of the image which is illustrated in FIG. 9B are the same as those which are illustrated in FIG. 20C.

According to the embodiment, it is possible to obtain the same effect as those in the first and third embodiments, and to obtain an effect of further reducing the reverse tilt domain compared to a case in which any one of the dark pixel and the light pixel is set to the correction target.

Sixth Embodiment

Subsequently, a sixth embodiment of the present invention will be described.

According to the embodiment, a video processing circuit 30 sets r dark pixels (r=2 in the embodiment) which are continuous in the direction opposite to the risk boundary from the dark pixel which comes into contact with the risk boundary to the pixels as the correction target, as in the above described second embodiment, and sets s light pixels (s=2 in the embodiment) which are continuous in the direction opposite to the risk boundary from the light pixel which comes into contact with the risk boundary to the pixels as the correction target, as in the above described fourth embodiment. In the configuration of the fifth embodiment, the video processing circuit 30 according to the embodiment may perform a correction of the dark pixel as in the above described second embodiment, and may perform a correction of the light pixel as in the above described fourth embodiment. Accordingly, a detailed configuration and descriptions of operation of the video processing circuit 30 will be omitted in the embodiment.

A specific example of the correction processing by the video processing circuit 30 will be described.

According to the embodiment, when a video signal Vid-in which defines the image which is illustrated in FIG. 21A is supplied, the video signal is corrected to be the video signal Vid-out which is illustrated in FIG. 21B.

Here, the image which is denoted by the video signal Vid-in is the same as that which is illustrated in FIG. 9A, and when the risk boundary is detected as illustrated in FIG. 9B, the correction unit 306 sets the dark pixel and the light pixel which are denoted by hatching of lattice in FIG. 22A to the pixels as the correction targets.

In addition, when θb is 90° according to the same way of thinking as that in the above described first embodiment, pixels as the correction target of the image which is illustrated in FIG. 9A are the same as those which are illustrated in FIG. 22B. When θb is 225°, pixels as the correction target of the image which is illustrated in FIG. 9B are the same as those which are illustrated in FIG. 22C.

According to the embodiment, it is possible to obtain the same effect as those in the second and fourth embodiments, and to obtain an effect of further reducing the reverse tilt domain compared to a case in which any one of the dark pixel and the light pixel is set to the correction target.

Seventh Embodiment

Subsequently, a seventh embodiment of the present invention will be described.

When it is an image with a movement, in an image at a current frame which is denoted by a video signal Vid-in, as described above, there is a case in which it is necessary to correct a video signal, and a case in which it is not necessary to correct the video signal when considering a movement including the previous frame which is immediately previous to the current frame, even when pixels come into contact with the risk boundary. The embodiment has a configuration in which video signals of the dark pixel and the light pixel are corrected as in the sixth embodiment, and in which pixels as the correction target are determined in consideration of the movement in the image from the previous frame to the current frame. In the following descriptions, the same configurations as those in the above described sixth embodiment are given the same reference numerals, and descriptions thereof will be suitably omitted.

Figure 23:
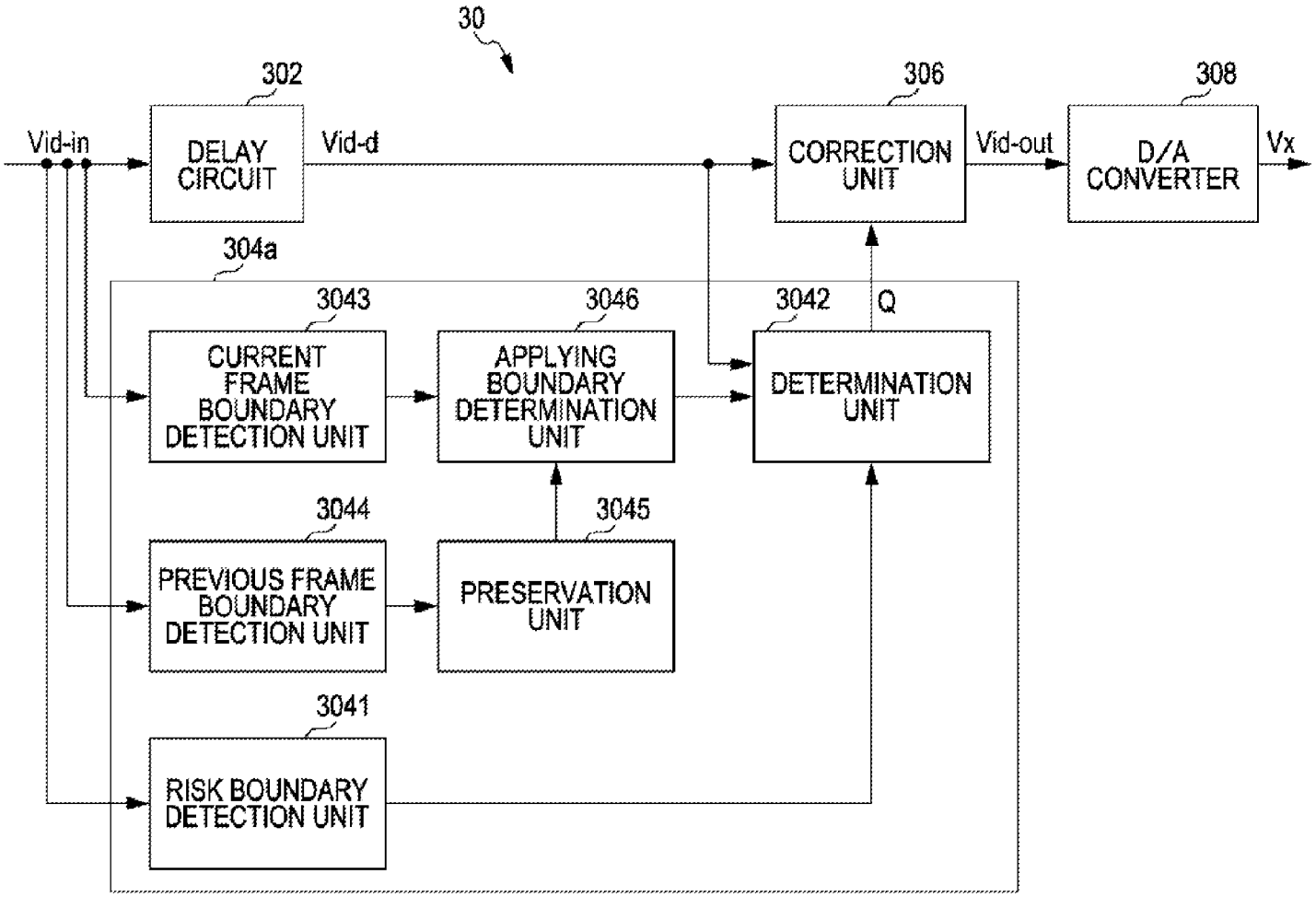
FIG. 23 is a diagram which illustrates a configuration of a video processing circuit according to a seventh embodiment of the present invention.

Subsequently, a video processing circuit 30 will be described in detail with reference to FIG. 23. As illustrated in FIG. 23, the video processing circuit 30 includes a delay circuit 302, a boundary detection unit 304*a*, a correction unit 306, and a D/A converter 308.

According to the embodiment, the boundary detection unit 304*a* includes a current frame boundary detection unit 3043, a previous frame boundary detection unit 3044, a preserving unit 3045, and an applying boundary determination unit 3046, in addition to a risk boundary detection unit 3041, and a determination unit 3042.

The current frame boundary detection unit 3043 analyzes an image which is denoted by a video signal Vid-in of the current frame, and determines whether or not there is a portion at which a dark pixel in a grayscale range a, and a light pixel in a grayscale range b are adjacent to each other. In addition, when it is determined that there is the adjacent portion, the current frame boundary detection unit 3043 detects a boundary which is the adjacent portion, and outputs position information of the boundary.

The previous frame boundary detection unit 3044 analyzes an image which is denoted by a video signal Vid-in of the previous frame, and detects a portion at which the dark pixel and the light pixel are adjacent to each other as a boundary. The previous frame boundary detection unit 3044 detects the boundary by executing processes of the same order as those in the current frame boundary detection unit 3043 based on the video signal Vid-in, and outputs position information of the detected boundary.

The preserving unit 3045 preserves the position information of the boundary which is detected by the previous frame boundary detection unit 3044, and outputs the information by delaying it by one frame period.

Accordingly, the boundary which is detected by the current frame boundary detection unit 3043 is related to the current frame, however, in contrast to this, the boundary which is detected by the previous frame boundary detection unit 3044, and is preserved in the preserving unit 3045 is related to the previous frame.

The applying boundary determination unit 3046 determines a boundary at which the same portion as the boundary of the previous frame image which is preserved in the preserving unit 3045 is excluded among boundaries of the current frame which are detected by the current frame boundary detection unit 3043 as an applying boundary. That is, the applying boundary is a boundary which is changed from the previous frame to the current frame, and in other words, a boundary which is not present in the previous frame, and is present in the current frame.

The determination unit 3042 determines whether or not pixels which are denoted by the video signal Vid-d which is output by being delayed is the dark pixel, or the light pixel which comes into contact with the risk boundary corresponding to the applying boundary which is determined by the applying boundary determination unit 3046 as the risk boundary which is detected by the risk boundary detection unit 3041, and performs the same determination as that in the above described sixth embodiment hereinafter. The correction unit 306 performs the same correction processing as that in the above described sixth embodiment.

A specific example of the correction processing by the video processing circuit 30 will be described.

The only difference in the video processing circuit 30 according to the embodiment from that in the six embodiment is that the pixels as the correction target are determined based on the risk boundary corresponding to the applying boundary, and may be the same as that in the sixth embodiment when determining how to correct the video signal of pixels based on the risk boundary.

Here, a case in which the image which is denoted by the video signal Vid-in in the previous frame is the same as that which is illustrated in FIG. 24A, for example, and when the image which is denoted by the video signal Vid-in in the current frame is the same as that which is illustrated in FIG. 24B, that is, a case in which a pattern which is formed by dark pixels in the grayscale range a makes a scroll movement to the left direction having the light pixel in the grayscale range b as a background is considered. In this case, the boundary which is detected by the previous frame boundary detection unit 3044 is the same as that which is illustrated in FIG. 24A, and the boundary which is detected by the current frame boundary detection unit 3043 is the same as that which is illustrated in FIG. 24B. In addition, a boundary which is overlapped with the boundary detected by the previous frame boundary detection unit 3044 among the boundaries which are detected by the current frame boundary detection unit 3043 is the applying boundary (refer to FIG. 24C). Accordingly, the risk boundary corresponding to the applying boundary is the same as that which is illustrated in FIG. 25A (when θb is 45°). It is possible to further reduce the pixels as the correction target than the above described first embodiment in the correction unit 306, since the pixel as the correction target are determined by the risk boundary corresponding to the applying boundary. According to the embodiment, when two dark pixels and two light pixels are set as the correction target, respectively, as in the above described sixth embodiment, the video signal after the correction processing is the same as that which is illustrated in FIG. 25B.

In addition, when θb is 90° according to the same way of thinking as that in the above described first embodiment, or when θb is 225°, similarly, it is also possible to determine pixels as the correction target by the risk boundary corresponding to the applying boundary.

According to the above described seventh embodiment, it is possible to obtain a common operational effect to the above described sixth embodiment, and to correct the video signal by concentrating on a portion at which the reverse tilt domain easily occurs. In this manner, it is possible to effectively suppress the occurrence of reverse tilt domain while further preventing the video signal from being changed.

In addition, the configuration in the embodiment in which the pixels as the correction target are determined by the movement of the image can also be adopted when performing the correction processing in the above described first to fifth embodiments.

Eighth Embodiment

Subsequently, an eighth embodiment of the present invention will be described.

In descriptions below, the same configurations as those in the seventh embodiment are given the same reference numerals, and descriptions thereof will be suitably omitted.

In the above described seventh embodiment, the video signal of the pixel has been corrected based on the light pixel and the dark pixel which are adjacent to each other by interposing the risk boundary therebetween in consideration of the movement of the image. In contrast to this, according to the embodiment, a video processing circuit 30 detects boundaries at which a dark pixel and a light pixel are adjacent to each other in the current frame, and sets pixels which come into contact with a risk boundary which has moved by one pixel (any one direction of vertical, horizontal, and oblique directions) from the previous frame to the current frame among the detected boundaries as the correction target. As described in advance using FIG. 28, when a region of dark pixels having the light pixels as a background moves by two or more pixels in each frame, such tailing is not prominent (or, is not easily perceived). Therefore, the video processing circuit 30 sets such pixels which are moved by one pixel, and are adjacent to the risk boundary to the pixels as the correction target, and does not set pixels other than those to the pixels as the correction target.

According to the embodiment, the applying boundary determination unit 3046 determines only the boundary which has moved by one pixel as the applying boundary from a boundary detection result using the current frame boundary detection unit 3043, and the previous frame boundary detection unit 3044, and does not determine the boundary which has not moved from the previous frame, and the risk boundary which has moved by two or more pixels as the applying boundary. In addition, similarly to the above described seventh embodiment, the determination unit 3042 determines whether or not pixels which are denoted by the video signal Vid-d which is output by being delayed is the dark pixel, or the light pixel which comes into contact with the risk boundary corresponding to the applying boundary which is determined by the applying boundary determination unit 3046 as the risk boundary which is detected by the risk boundary detection unit 3041, and performs the same determination as that in the above described seventh embodiment hereinafter. The correction unit 306 performs the same correction processing as that in the above described seventh embodiment. In this manner, the correction unit 306 is able to correct the video signal by further concentrating on the portions at which the reverse tilt domain easily occurs.

Figure 26:
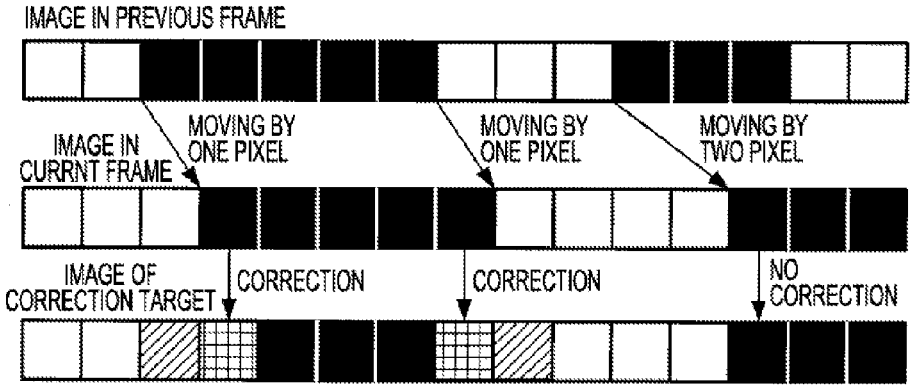
FIG. 26 is an explanatory diagram which illustrates correction processing in a video processing circuit according to an eighth embodiment of the present invention.

FIG. 26 is a diagram which illustrates correction processing according to the embodiment.

As illustrated in FIG. 26, when the image in the previous frame meets the image in the current frame, the boundary is changed from the previous frame to current frame as illustrated in the figure. In this manner, when the boundary is changed, only dark pixels which satisfy a condition of movement of 1 pixel/1 frame, and come into contact with the boundary are set to the correction target, and when the boundary is moved by two pixels, for example, even the dark pixels which come into contact with are not set to the correction target. In this manner, the correction unit 306 is able to perform the correction by further concentrating on the portions at which the reverse tilt domain easily occurs.

In addition, the configuration in the embodiment in which the pixels as the correction target are determined by the movement of the boundary of one pixel can also be adopted when performing the correction processing in the above described first to fifth embodiments.

MODIFICATION EXAMPLES

Modification Example 1

In the video processing circuit 30 in each embodiment which is described above, the same correction has been made in the first and third fields, and the same correction has been made in the second and fourth fields, among four fields configuring one frame, however, it is also possible to perform the correction so that the correction which has been performed in the first and third fields is performed in the second and fourth fields, and the correction which has been performed in the second and forth fields is performed in the first and third fields. In addition, in the video processing circuit 30, a combination of fields in which the same correction is performed is not limited to the combination. In addition, in the video processing circuit 30, the method of correction processing may be different in each frame. In addition, in the video processing circuit 30, the number of fields in which the same correction is performed in one frame period may not be the same numbers, respectively, and it is preferable that the correction of increasing and decreasing the grayscale level of the video signal (application voltage) be performed at least in one frame period. When considering this, the field in which the video signal is not corrected by the video processing circuit 30 may be included in a part of one frame period.

Modification Example 2

In the above described each embodiment, the dark pixel and the light pixel which come into contact with the risk boundary are set to pixels as the correction target in the video processing circuit 30, however, the pixels as the correction target in which the risk boundary is not detected may be determined as the correction target. Specifically, the video processing circuit 30 may set all of light pixels which come into contact with the boundary between the dark pixel and the light pixel as the correction target, or may set all of the light pixels which come into contact with the boundary between the light pixel and dark pixel as the correction target. In addition, the video processing circuit 30 may set all of dark pixels which come into contact with the boundary which is changed from the previous frame to the current frame as the correction target, and may set all of light pixels which come into contact with the boundary which is changed from the previous frame to the current frame as the correction target. Further, the video processing circuit 30 may set the dark pixel, or the light pixel which comes into contact with a boundary which is moved by one pixel from the previous frame to the current frame as the correction target. In addition, the video processing circuit 30 may adopt such a configuration in which the risk boundary is not detected even in a case in which pixels other than pixels which come into contact with the boundary are set as the correction target as in the above described second, fourth, and sixth embodiments.

Modification Example 3

In the above described each embodiment, the example in which the VA method is used in the liquid crystal 105 has been described, however, it may be a TN method. The reason is the same as that which is disclosed in JP-A-2011-107174.

Modification Example 4

When the correction unit 306 performs the correction of the video signal, the video signal may be corrected to a video signal with a grayscale level corresponding to the brightness of the image in the display area 101. For example, the correction unit 306 obtains information as an index of the brightness of the display area 101, and the higher the level of the brightness which is determined by the obtained information (that is, bright), the higher the grayscale level of the corrected video signal. The reason for doing this is because the brighter the display area 101, the harder the change in grayscale level due to a correction attracting attention, and the defective display is not easily perceived by a user even when the grayscale level after correction is set to be high in order to give priority to reducing of the reverse tilt domain. The information as the index of the brightness of the display area 101 is the brightness (for example, illuminance) of a circumstance of video display in the periphery of the display area 101. In this case, the correction unit 306 may determine the grayscale level after correction by obtaining a detection result of an optical sensor which is provided in the liquid crystal display device 1. In addition to this, the correction unit 306 may obtain a grayscale level of an input video signal as the information as the index of the brightness (for example, mean value of grayscale level of input video signal of one frame). This is because the display area 101 becomes also bright, when an image of a video signal with high grayscale level is displayed. In addition, the correction unit 306 may obtain mode information which designates any of a plurality of video display modes which define the brightness of the image which is displayed in the display area 101, or a contrast ratio. The correction unit 306 uses luminance which is determined in the video display mode, and a correction amount corresponding to the contrast ratio. In this case, the correction unit 306 may correct the video signal to be the video signal with the grayscale level corresponding to the display mode in which the grayscale level is set to be high in order of, a so-called, dynamic mode>a normal mode>a power saving mode.

In addition, the correction unit 306 may obtain a detection result of a temperature sensor which detect an ambient temperature, or a temperature in the device of the liquid crystal display device 1, and determine the grayscale level of the video signal after the correction according to the temperature which is denoted by the detection result. In general, since the higher the temperature, the higher the transmittance of the liquid crystal element, it is preferable for the correction unit 306 to perform a correction in which the video signal is corrected to be the video signal with the grayscale level corresponding to the temperature so as to make a dependency of the transmittance in temperature small.

In addition, when determining the video signal after the correction (application voltage of liquid crystal element 120) the correction unit 306 may have a configuration in which a look-up table is referenced, in addition to a configuration in which a calculation is made using an arithmetic expression.

Modification Example 5

In the above described second, fourth, and sixth embodiments, r is set to two, and s is set to two, however, these values are merely examples. Accordingly, the r and s may be integers of "2" or more, respectively, and these values may be different from each other.

In addition, the video processing circuit according to the embodiment of the invention is not limited to the quad-speed driving, and can be applied to a liquid crystal display device in which, for example, X-speed driving such as double-speed driving, or octa-speed driving is adopted.

Modification Example 6

In each of the embodiments which are described above, the video signal Vid-in is set to a signal which designate the grayscale level of pixels, however, the video signal may directly designate the application voltage of the liquid crystal element. When the video signal Vid-in designates the application voltage of the liquid crystal element, a configuration is possible in which a boundary is determined using a designated application voltage, and a voltage is corrected.

In addition, in each embodiment, the liquid crystal element 120 may be a reflection type not being limited to the transmission type.

Modification Example 7

Figure 27:
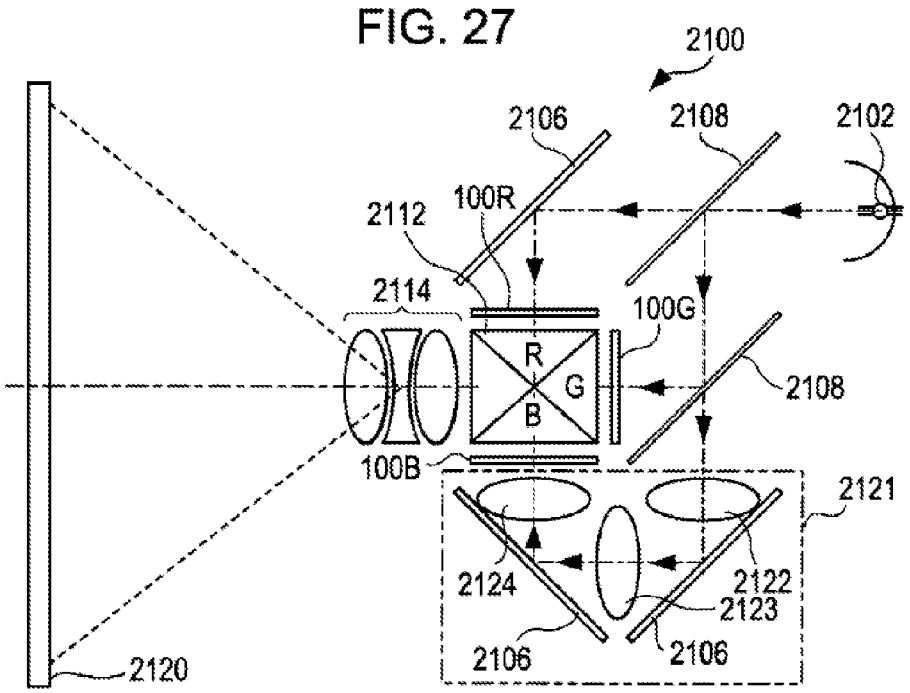
FIG. 27 is a diagram which illustrates a projector to which a liquid crystal display device is applied.

Subsequently, as an example of an electronic apparatus in which the liquid crystal display device according to the above described embodiments is used, a projection type display device (projector) in which the liquid crystal panel 100 is used as a light bulb will be described. FIG. 27 is a plan view which illustrates a configuration of the projector.

As illustrated in the figure, a lamp unit 2102 which is formed by a white light source such as a halogen lamp is provided in a projector 2100. Transmitted light which is emitted from the lamp unit 2102 is separated into three primary colors of R (red), G (green), and B (blue) by three mirrors 2106, and two dichroic mirrors 2108 which are arranged inside thereof, and are respectively guided to light bulbs of 100R, 100G, and 100B which correspond to each primary color. In addition, light of a B color has a long optical path compared to the R color and G color, the B color is guided through a relay lens system 2121 which is configured by an input lens 2122, a relay lens 2123, and an output lens 2124 so as to prevent a loss thereof.

In the projector 2100, three sets of the liquid crystal display device including the liquid crystal panel 100 are provided corresponding to each of the R color, G color, and B color. A configuration of the light bulbs 100R, 100G, and 100B is the same as that in the above described liquid crystal panel 100. In the configuration, a video signal for designating a grayscale level of a component of each primary color of R, G, and B is supplied from an external higher circuit, respectively, and the light bulbs 100R, 100G, and 100B are respectively driven.

Light beams which are respectively modulated by the light bulbs 100R, 100G, and 100B are input from three directions to a dichroic prism 2112. In addition, in the dichroic prism 2112, the light beams of R color and B color are refracted by 90°, however, on the other hand, the light of G color goes straight. Accordingly, a color image is projected on a screen 2120 by a projection lens 2114 after images of each primary color are composed.

In addition, since the light corresponding to each of the R color, G color, and B color is input to the light bulbs 100R, 100G, and 100B by a dichroic mirror 2108, it is not necessary to provide a color filter. In addition, since an image which transmits the light bulb 100G is projected as is, in contrast to images which transmit the light bulbs 100R and 100B which are projected after being reflected by the dichroic prism 2112, a configuration is made in which the horizontal scanning direction by the light bulbs 100R and 100B is set to be opposite to the horizontal scanning direction by the light bulbs 100G, and an image in which the right and left are reversed is displayed.

As the electronic apparatus, there are a television, a video tape recorder of a type of a view finder, or a direct-view monitor, a car navigation, a pager, an electronic organizer, a calculator, a word processor, a work station, a TV phone, a POS terminal, a digital still camera, a mobile phone, equipment with a touch panel, and the like in addition to the projector described with reference to FIG. 27. In addition, it is needless to say that the above described liquid crystal display device can be applied to these various electronic apparatuses.

This application claims priority to Japan Patent Application No. 2012-016389 filed Jan. 30, 2012, the entire disclosures of which are hereby incorporated by reference in their entireties.

What is claimed is:

1. A driving unit which drives a liquid crystal device having a plurality of pixels, the driving unit comprising:

a control circuit that:

receives a first video signal that designates a first grayscale;

receives a second video signal that designates a second grayscale;

receives a third video signal that designates the second grayscale;

generates a first voltage corresponding to the first grayscale based on the first video signal corresponding to a first pixel among the plurality of pixels;

generates a second voltage corresponding to the second grayscale based on the second video signal corresponding to a second pixel among the plurality of pixels;

generates a third voltage and a fourth voltage based on the third video signal corresponding to a third pixel, the third pixel being disposed between the first pixel and the second pixel; and a driving circuit that:

supplies the first voltage to the first pixel, supplies the second voltage to the second pixel, and supplies the third voltage to the third pixel in a first period; and supplies the first voltage to the first pixel, supplies the second voltage to the second pixel, and supplies the fourth voltage to the third pixel in a second period, wherein one of the third voltage and the fourth voltage is higher than the second voltage, and the other of the third voltage and the fourth voltage is lower than the second voltage, and one of the third voltage and the fourth voltage corresponds to a grayscale having a white level or a black level.

2. The driving unit of the liquid crystal device according to claim 1, wherein the control circuit corrects the third video signal to be a fourth video signal designating a third grayscale, and a fifth video signal designating a fourth grayscale, and wherein the control circuit generates the third voltage corresponding to the third grayscale which is designated by the fourth video signal, and the fourth voltage corresponding to the fourth grayscale which is designated by the fifth video signal.

3. The driving unit of the liquid crystal device according to claim 1, wherein the third pixel displays the second grayscale in the first period and the second period by displaying a third grayscale in the first period, and displaying a fourth grayscale in the second period.

4. The driving unit of the liquid crystal device according to claim 1, wherein one of the third and fourth voltages is a maximum voltage which is used when expressing a grayscale.

5. The driving unit of the liquid crystal device according to claim 1, wherein one of the third and fourth voltages is a minimum voltage which is used when expressing a grayscale.

6. The driving unit of the liquid crystal device according to claim 1, further comprising:

a boundary detection unit, wherein the boundary detection unit detects a risk boundary which is a part of a boundary between the first pixel and the second pixel, and is determined by tilt azimuth of a liquid crystal, wherein a video processing unit supplies the third voltage to the third pixel in the first period, and supplies the fourth voltage to the third pixel in the second period when the third pixel comes into contact with the risk boundary.

7. The driving unit of the liquid crystal device according to claim 1, further comprising:

a boundary detection unit, wherein the boundary detection unit detects a boundary which is changed from a frame which is immediately previous to a current frame, to the current frame, between boundaries of the first pixel and the second pixel, wherein a video processing unit supplies the third voltage to the third pixel in the first period, and supplies the fourth voltage to the third pixel in the second period when the third pixel comes into contact with the changed boundary.

8. The driving unit of the liquid crystal device according to claim 7, wherein the boundary detection unit detects a boundary which is moved by one pixel from the frame which is immediately previous to the current frame, to the current frame, between the boundaries of the first pixel and the second pixel.

9. The driving unit according to claim 1, wherein the driving unit is included in the liquid crystal device.

10. The driving unit according to claim 9, wherein the liquid crystal device is included in an electronic apparatus.

11. A driving unit which drives a liquid crystal device having a plurality of pixels, the driving unit comprising:

a control circuit that:

receives a first video signal that designates a first grayscale;

receives a second video signal that designates a second grayscale;

generates a third voltage and a fourth voltage based on the first video signal corresponding to a first pixel among the plurality of pixels;

generates a fifth voltage and a sixth voltage based on the second video signal corresponding to a second pixel which is adjacent to the first pixel; and a driving circuit that:

supplies the third voltage to the first pixel and supplies the fifth voltage to the second pixel in a first period;

supplies the fourth voltage to the first pixel and supplies the sixth voltage to the second pixel in a second period;

wherein one of the third and fourth voltages is higher than the first voltage, and the other of the third and fourth voltages is lower than the first voltage, one of the fifth and sixth voltages is higher than the second voltage, and the other of the fifth and sixth voltages is lower than the second voltage, one of the third and fourth voltages corresponds to a grayscale having one of a white level or a black level, and one of the fifth and sixth voltages corresponds to a grayscale having the other of a white level or a black level.

12. A driving method which drives a liquid crystal device including a plurality of pixels comprising:

receiving a first video signal that designates a first grayscale;

receiving a second video signal that designates a second grayscale;

receiving a third video signal that designates the second grayscale;

generating a first voltage corresponding to the first grayscale based on the first video signal corresponding to a first pixel among the plurality of pixels;

generating a second voltage corresponding to the second grayscale based on the second video signal corresponding to a second pixel among the plurality of pixels;

generating a third voltage and a fourth voltage based on the third video signal corresponding to a third pixel, the third pixel being disposed between the first pixel and the second pixel;

supplying the first voltage to the first pixel, supplying the second voltage to the second pixel, and supplying the third voltage to the third pixel in a first period;

supplying the first voltage to the first pixel, supplying the second voltage to the second pixel, and supplying the fourth voltage to the third pixel in a second period, wherein one of the third voltage and the fourth voltage is higher than the second voltage, and the other of the third voltage and the fourth voltage is lower than the second voltage, and one of the third voltage and the fourth voltage corresponds to a grayscale having a white level or a black level.

* * * * *